US009557069B2

(12) United States Patent
Matsui et al.

(10) Patent No.: US 9,557,069 B2
(45) Date of Patent: Jan. 31, 2017

(54) DEHUMIDIFICATION SYSTEM

(71) Applicants: DAIKIN INDUSTRIES, LTD., Osaka-shi, Osaka (JP); DAIKIN APPLIED SYSTEMS CO., LTD., Minato-ku, Tokyo (JP)

(72) Inventors: Nobuki Matsui, Osaka (JP); Eisaku Okubo, Osaka (JP); Toshiyuki Natsume, Osaka (JP); Yasunori Okamoto, Osaka (JP); Koichi Kuwana, Tokyo (JP); Takahiro Kusabe, Tokyo (JP); Tetsuro Iwata, Osaka (JP); Hideki Uchida, Osaka (JP)

(73) Assignees: DAIKIN INDUSTRIES, LTD., Osaka-Shi (JP); DAIKIN APPLIED SYSTEMS CO., LTD., Tokyo (JP)

( * ) Notice: Subject to any disclaimer, the term of this patent is extended or adjusted under 35 U.S.C. 154(b) by 429 days.

(21) Appl. No.: 14/342,944

(22) PCT Filed: Sep. 28, 2012

(86) PCT No.: PCT/JP2012/006243
§ 371 (c)(1),
(2) Date: Mar. 5, 2014

(87) PCT Pub. No.: WO2004/046715
PCT Pub. Date: Apr. 4, 2013

(65) Prior Publication Data

US 2014/0202190 A1 Jul. 24, 2014

(30) Foreign Application Priority Data

Sep. 29, 2011 (JP) ..... 2011-214432
Apr. 27, 2012 (JP) ..... 2012-103684

(51) Int. Cl.
*F25D 23/00* (2006.01)
*F24F 3/14* (2006.01)
*F24F 5/00* (2006.01)

(52) U.S. Cl.
CPC ..... *F24F 3/1423* (2013.01); *F24F 3/1405* (2013.01); *F24F 3/1429* (2013.01); *F24F 5/001* (2013.01);
(Continued)

(58) Field of Classification Search
CPC ..... F24F 3/1423; F24F 3/1405; F24F 3/1429; F24F 5/001; F24F 5/0014; F24F 2203/021; F24F 2203/1016; F24F 2303/1032; F24F 2203/108
See application file for complete search history.

(56) References Cited

U.S. PATENT DOCUMENTS

2006/0086120 A1 4/2006 Kashirajima et al.
2007/0039343 A1* 2/2007 Ikegami ..... B01D 53/263 62/271

FOREIGN PATENT DOCUMENTS

JP 10-85546 A 4/1998
JP 2003-314856 A 11/2003
(Continued)

OTHER PUBLICATIONS

International Search Report for PCT/JP2012/006243 mailed on Dec. 25, 2012.
Written Opinion of the International Searching Authority for PCT/JP2012/006243 mailed on Dec. 25, 2012.

*Primary Examiner* — Elizabeth Martin
(74) *Attorney, Agent, or Firm* — Birch, Stewart, Kolasch & Birch, LLP

(57) ABSTRACT

A dehumidification system includes a first dehumidification unit having an outdoor air cooling heat exchanger, a second dehumidification unit using two adsorption heat exchangers
(Continued)

such that an air passage is switched, and a third dehumidification unit having an adsorption rotor. Low-temperature low-humidity air cooled and dehumidified in the second dehumidification unit is supplied to the third dehumidification unit to reduce energy for recovery of the third dehumidification unit and to realize energy conservation in the dehumidification system and reduction in cost of the dehumidification system.

17 Claims, 10 Drawing Sheets

(52) U.S. Cl.
CPC ..... *F24F 5/0014* (2013.01); *F24F 2203/021* (2013.01); *F24F 2203/026* (2013.01); *F24F 2203/108* (2013.01); *F24F 2203/1016* (2013.01); *F24F 2203/1032* (2013.01)

(56) References Cited

FOREIGN PATENT DOCUMENTS

| | | | |
|---|---|---|---|
| JP | 2004-8914 | A | 1/2004 |
| JP | 3762138 | B2 | 4/2006 |
| JP | 2006-125670 | A | 5/2006 |
| JP | 2011-64439 | A | 3/2011 |

* cited by examiner (A)

(B)

DEHUMIDIFICATION SYSTEM

TECHNICAL FIELD

The present disclosure relates to a dehumidification system configured to supply dehumidified air to the inside of a room.

BACKGROUND ART

Conventionally, dehumidification systems each configured to supply dehumidified air to the inside of a room have been known. Patent Documents 1 and 2 disclose the dehumidification systems of this type.

Patent Documents 1 and 2 describe the configuration in which, in an air passage, three adsorption rotors are arranged in series and in three stages. The air passage includes an air supply passage for supplying outdoor air processed by the adsorption rotors to the inside of the room, and an air discharge passage for discharging indoor air to the outside of the room. Each adsorption rotor is disposed so as to extend over both of the air supply passage and the air discharge passage, and is rotatable about a rotary shaft interposed between the air supply passage and the air discharge passage.

The adsorption rotor is configured such that moisture contained in air flowing through the air supply passage adsorbs onto the adsorption rotor and therefore the air is dehumidified. Moreover, the adsorption rotor is configured to be recovered by dissipating moisture to air flowing through the air discharge passage. In the air discharge passage, an air heater configured to heat air is provided so that the heated air can be used for recovery of the adsorption rotor. When the amount of moisture adsorbing onto part of the adsorption rotor increases, the adsorption rotor rotates to move such a part to the air discharge passage. After the adsorption rotor is recovered by dissipating the moisture, the adsorption rotor is re-used for adsorption. According to the foregoing configuration, low-humidity air flowing through an air passage for adsorption is continuously supplied to the inside of a room, and dehumidifies the inside of the room. Moreover, heated indoor air is used for recovery of the adsorption rotor, and then is discharged to the outside of the room.

Since outdoor air passes through the adsorption rotor three times, air supplied to the inside of the room has a low dew point, and therefore can be used as air (i.e., air having a dew point of about −50° C.) supplied to, e.g., a dry clean room where lithium-ion batteries are manufactured. In the system of this type, it is often the case that the adsorption rotors are arranged in two stages.

CITATION LIST

Patent Document

PATENT DOCUMENT 1: Japanese Patent No. 3762138

PATENT DOCUMENT 2: Japanese Unexamined Patent Publication No. 2011-064439

SUMMARY OF THE INVENTION

Technical Problem

However, in a system using a plurality of adsorption rotors, it is necessary that each adsorption rotor is provided with a heater for recovery to form a dehumidification/recovery unit. Since a cost for adsorption rotor itself is high, and a temperature required for recovery of the adsorption rotor by the heater is high, a running cost required for the heat amount of the heater is high. Moreover, in a system using adsorption rotors arranged in multiple stages, the humidity of air for dehumidification after the air passes through the adsorption rotors decreases, but the temperature of such air increases due to adsorption heat generated when the air passes through the adsorption rotors and heating performed for recovery of the adsorption rotors by the heaters. For such reasons, it is necessary that air for dehumidification is cooled at an inlet of the adsorption rotor, and therefore energy for such cooling is also required.

Particularly in a manufacturing process for lithium ion batteries, an energy usage of an air conditioning system (i.e., a dehumidification system) occupies about 50% of the total energy, and energy conservation in this system contributes a lot to reduction in cost of lithium ion batteries. However, since a great heat amount is actually required for recovery of adsorption rotors, it is extremely difficult to reduce a cost of dehumidification systems.

The present disclosure has been made in view of the foregoing, and aims to conserve energy in a dehumidification system and reduce a cost of the dehumidification system.

Solution to the Problem

A first aspect of the invention is intended for a dehumidification system including an air passage (40, 50) having an air supply passage (40) through which air supplied to an indoor space (S) passes, and an air discharge passage (50) through which air discharged to an outside of a room passes; and a dehumidification unit (60, 20, 30) disposed in the air passage (40, 50). The dehumidification unit (60, 20, 30) includes a first dehumidification unit (60), a second dehumidification unit (20), and a third dehumidification unit (30) which are arranged in this order from a side close to an inlet of air supplied to an inside of the room toward the indoor space (5).

The first dehumidification unit (60) includes an outdoor air cooling heat exchanger (61) configured to cool and dehumidify air supplied to the inside of the room. The second dehumidification unit (20) includes two adsorption heat exchangers (22, 24) configured to be switchable such that an adsorption side and a recovery side interchange with each other, and is configured such that air dehumidified in the first dehumidification unit (60) is further dehumidified in one of the adsorption heat exchangers (22, 24) on the adsorption side. The third dehumidification unit (30) includes an adsorption rotor (31), part of which serves as an adsorption part (32) and another part of which serves as a recovery part (34), and is configured such that air dehumidified in the second dehumidification unit (20) is further dehumidified in the adsorption part (32).

In the first aspect of the invention, air, such as outdoor air, to be supplied to the inside of the room is first cooled and dehumidified by the outdoor air cooling heat exchanger (61) of the first dehumidification unit (60). The air cooled and dehumidified in the outdoor air cooling heat exchanger (61) passes through the second dehumidification unit (20), and moisture adsorbs onto an adsorbent of the adsorption heat exchanger on the adsorption side. Since adsorption heat generated when moisture contained in air adsorbs onto the adsorption heat exchanger (22, 24) is absorbed by the adsorption heat exchanger (22, 24), an increase in air temperature is reduced. Moreover, since the adsorption heat exchangers (22, 24) are switched such that the adsorption side and the recovery side interchange with each other, air to be supplied to the indoor space (S) always passes through the adsorption heat exchanger on the adsorption side. The air whose temperature increase is reduced and whose humidity is reduced after passage of the adsorption heat exchanger (22, 24) passes through the adsorption rotor (31) of the third dehumidification unit (30). In the adsorption rotor (31), moisture contained in the air further adsorbs onto an adsorbent. Then, the low-dew-point air having passed through the adsorption rotor (31) is supplied to the indoor space (S).

A second aspect of the invention is intended for the dehumidification system of the first aspect of the invention, in which the third dehumidification unit (30) further includes, in addition to the adsorption rotor (31), an air heater (65) disposed on a side close to an inlet of air for recovery of the adsorption rotor (31).

In the second aspect of the invention, air heated by the air heater (65) is supplied to the adsorption rotor (31) to recover the adsorption rotor (31). Since such air is air cooled by the adsorption heat exchanger (22, 24), an increase in temperature of the adsorption rotor (31) is reduced, and therefore recovery of the adsorption rotor (31) at a low temperature can be realized.

A third aspect of the invention is intended for the dehumidification system of the second aspect of the invention, in which the air heater (65) is a recovery heat exchanger which is provided in a refrigerant circuit (70*a*, 120) configured to perform a refrigeration cycle and which serves as a condenser.

In the third aspect of the invention, air heated by the recovery heat exchanger (65) is supplied to the adsorption rotor (31) to recover the adsorption rotor (31). Since such air is air cooled by the adsorption heat exchanger (22, 24), an increase in temperature of the adsorption rotor (31) is reduced, and therefore recovery of the adsorption rotor (31) at a low temperature can be realized.

A fourth aspect of the invention is intended for the dehumidification system of the third aspect of the invention, in which the refrigerant circuit (70*a*, 120) is a refrigerant circuit in which the recovery heat exchanger (65) serves as the condenser and the outdoor air cooling heat exchanger (61) serves as an evaporator.

In the fourth aspect of the invention, refrigerant dissipates, in the recovery heat exchanger (65), heat taken from outdoor air in the outdoor air cooling heat exchanger (61), thereby recovering the adsorption rotor (31).

A fifth aspect of the invention is intended for the dehumidification system of the second aspect of the invention, in which the air heater (65) is an electric heater or a steam heater.

In the fifth aspect of the invention, air heated by the air heater (65) such as the electric heater or the steam heater is supplied to the adsorption rotor (31) to recover the adsorption rotor (31). Since such air is air cooled by the adsorption heat exchanger (22, 24), an increase in temperature of the adsorption rotor (31) is reduced, and therefore recovery of the adsorption rotor (31) at a low temperature can be realized.

A sixth aspect of the invention is intended for the dehumidification system of any one of the first to fifth aspects of the invention, in which the second dehumidification unit (20) and the third dehumidification unit (30) are configured such that the adsorption part (32) of the adsorption rotor (31) is positioned downstream of the air supply passage (40) relative to one of the adsorption heat exchangers (22, 24) on the adsorption side, and the other one of the adsorption heat exchangers (22, 24) on the recovery side is positioned downstream of the air discharge passage (50) passing through the recovery part (34) of the adsorption rotor (31).

In the sixth aspect of the invention, air flowing out from the adsorption heat exchanger (22, 24) on the adsorption side is further dehumidified in the adsorption part (32) of the adsorption rotor (31). Meanwhile, air flowing out from the recovery part (34) of the adsorption rotor (31) recovers the adsorption heat exchanger (22, 24) on the recovery side.

A seventh aspect of the invention is intended for the dehumidification system of the sixth aspect of the invention, in which the adsorption heat exchangers (22, 24) of the second dehumidification unit (20) are two heat exchangers provided in a refrigerant circuit (20*a*), the second dehumidification unit (20) includes a refrigerant flow path switching mechanism (25) configured to reverse a refrigerant flow direction in the refrigerant circuit (20*a*) to alternately switch each adsorption heat exchanger (22, 24) to serve as an evaporator on the adsorption side or a condenser on the recovery side, and an air passage switching mechanism (26, 27) configured to switch an air flow to connect one of the adsorption heat exchangers (22, 24) serving as the evaporator to the air supply passage (40) and to connect the other one of the adsorption heat exchangers (24, 22) serving as the condenser to the air discharge passage (50), the adsorption rotor (31) of the third dehumidification unit (30) is disposed so as to extend over both of the air supply passage (40) and the air discharge passage (50), and is rotatable about a rotary shaft interposed between the air supply passage (40) and the air discharge passage (50), and part of the adsorption rotor (31) through which the air supply passage (40) passes serves as the adsorption part (32), and another part of the adsorption rotor (31) through which the air discharge passage (50) passes serves as the recovery part (34).

In the seventh aspect of the invention, the refrigerant flow direction of the refrigerant circuit (20*a*) is switched such that each adsorption heat exchanger (22, 24) is alternately switched to the evaporator or the condenser. Moreover, the air passage is also switched such that the adsorption heat exchanger (22, 24) on the adsorption side, i.e., the evaporator, is connected to the air supply passage (40) and that the adsorption heat exchanger (22, 24) on the recovery side, i.e., the condenser, is connected to the air discharge passage (50). Air flowing out from the adsorption heat exchanger (22, 24) on the adsorption side is dehumidified in the adsorption part (32) of the adsorption rotor (31), and air flowing out from the recovery part (34) of the adsorption rotor (31) recovers the adsorption heat exchanger (22, 24) on the recovery side.

An eighth aspect of the invention is intended for the dehumidification system of any one of the first to seventh aspects of the invention, in which the second dehumidification unit (20) and the third dehumidification unit (30) are directly connected together through the air supply passage (40) without an intermediate cooler being interposed therebetween.

In the eighth aspect of the invention, dehumidified air cooled in the second dehumidification unit (20) is supplied to the third dehumidification unit (30) without the air passing through the intermediate cooler, and then is further dehumidified in the third dehumidification unit (30).

A ninth aspect of the invention is intended for the dehumidification system of any one of the first to eighth aspects of the invention, further includes a return air passage (58) connecting a return air port (58*a*) communicating with the indoor space (S) to part of the air supply passage (40) between the second dehumidification unit (20) and the third dehumidification unit (30).

In the ninth aspect of the invention, air returning from the indoor space (S) to the air supply passage (40) through the return air passage (58) joins air having passed through the second dehumidification unit (20), and then the joined air is supplied to the third dehumidification unit (30).

A tenth aspect of the invention is intended for the dehumidification system of the ninth aspect of the invention, in which a return air fan (59) configured to push indoor air toward the air supply passage (40) is provided in the return air passage (58).

In the tenth aspect of the invention, the return air passage (58) and part of the air supply passage (40) communicating with the return air passage (58) are under a positive pressure. If such a part of the system is under a negative pressure, there is a possibility that moisture contained in outdoor air is sucked into the air supply passage (40). According to the present disclosure, since the foregoing part of the system is maintained at the positive pressure, an increase in humidity of the system can be reduced or prevented.

An eleventh aspect of the invention is intended for the dehumidification system of the ninth aspect of the invention, in which a return air cooler (67) configured to cool air flowing through the return air passage (58) is provided in the return air passage (58).

In the eleventh aspect of the invention, return air is cooled, and then is sent back to the air supply passage (40). Thus, air to be supplied can be maintained at a low temperature after such air joins the return air. Since air to be supplied to the adsorption rotor (31) is maintained at a low temperature, the recovery temperature of the adsorption rotor (31) can be suppressed at a low level.

A twelfth aspect of the invention is intended for the dehumidification system of any one of the first to eleventh aspects of the invention, in which an adsorbent provided on the adsorption heat exchangers (22, 24) is an adsorbent showing an adsorption isotherm indicating that a higher relative humidity of air results in a greater adsorption amount per unit increment of the relative humidity, and an adsorbent provided on the adsorption rotor (31) is an adsorbent showing an adsorption isotherm indicating that a lower relative humidity of air results in a greater adsorption amount per unit increment of the relative humidity.

In the twelfth aspect of the invention, in the adsorption heat exchangers (22, 24) of the second dehumidification unit (20) processing high-humidity air, a large amount of moisture adsorbs onto the adsorbent whose adsorption amount is the maximum at a high relative humidity (i.e., a high water vapor partial pressure). On the other hand, in the adsorption rotor (31) of the third dehumidification unit (30) processing a relatively-low-humidity air, moisture efficiently adsorbs onto the adsorbent whose adsorption amount is the maximum at a low relative humidity.

A thirteenth aspect of the invention is intended for the dehumidification system of any one of the first to twelfth aspects of the invention, in which, in an existing system including the first dehumidification unit (60) and the third dehumidification unit (30), the second dehumidification unit (20) is connected between the first dehumidification unit (60) and the third dehumidification unit (30).

In the thirteenth aspect of the invention, the second dehumidification unit (20) is, as an optional unit, connected between the first dehumidification unit (60) and the third dehumidification unit (30) of the existing system to form the dehumidification system including three stages of the dehumidification units (60, 20, 30). Since the triple-stage dehumidification system is formed as just described, the recovery temperature of the adsorption rotor (31) can be suppressed at a low level.

A fourteenth aspect of the invention is intended for the dehumidification system of the fourth aspect of the invention, in which a reheat heat exchanger (64) which is disposed downstream of the adsorption rotor (31) in the air supply passage (40) and which serves as the condenser, and a return air cooling heat exchanger (67) which is disposed in a return air passage (58) connecting a return air port (58*a*) communicating with the indoor space (S) to part of the air supply passage (40) between the second dehumidification unit (20) and the third dehumidification unit (30) and which is provided as an air cooler serving as the evaporator are connected to the refrigerant circuit (70*a*, 120).

In the fourteenth aspect of the invention, air dehumidified in the adsorption rotor (31) is heated by the reheat heat exchanger (64), and then is supplied to the inside of the room. As a result, the relative humidity of the air supplied to the inside of the room decreases. Moreover, indoor air is cooled in the return air cooling heat exchanger (67), and then is sent back to the upstream side of the adsorption rotor (31).

In the present disclosure, the reheat heat exchanger (64) and the return air cooling heat exchanger (67) are connected to the refrigerant circuit (70*a*, 120). In the refrigerant circuit (70*a*, 120), compressed refrigerant flows through the reheat heat exchanger (64) serving as the condenser. That is, in the reheat heat exchanger (64), refrigerant is condensed by dissipating heat to air. After the pressure of the condensed refrigerant is reduced, such refrigerant flows through the return air cooling heat exchanger (67) serving as the evaporator. That is, in the return air cooling heat exchanger (67), refrigerant is evaporated by absorbing heat from air. As just described, in the present disclosure, heat taken from air in the return air cooling heat exchanger (67) is used for heating of air by the reheat heat exchanger (64).

A fifteenth aspect of the invention is intended for the dehumidification system of the fourteenth aspect of the invention, in which the refrigerant circuit (70*a*, 120) is a single-stage refrigeration cycle type refrigerant circuit (70*a*) in which the condenser (64, 65) and the evaporator (61, 67) are connected to a single closed circuit.

In the fifteenth aspect of the invention, the condenser (64, 65) and the evaporator (61, 67) are connected to the single-stage refrigeration cycle type refrigerant circuit (70*a*). Thus, the refrigerant circuit (70*a*) is simplified.

A sixteenth aspect of the invention is intended for the dehumidification system of the fifteenth aspect of the invention, in which a variable displacement compressor (80) configured to control, when a required capacity of the condenser (64, 65) is higher than a required capacity of the evaporator (61, 67), a rotational speed thereof such that a condensation pressure approaches a target pressure and to control, when the required capacity of the evaporator (61, 67) is higher than the required capacity of the condenser (64, 65), the rotational speed thereof such that an evaporation pressure approaches a target pressure is connected to the refrigerant circuit (70*a*).

The variable displacement compressor (80) whose rotational speed is adjustable is connected to the refrigerant circuit (70*a*) of the sixteenth aspect of the invention. The rotational speed of the compressor (80) is adjusted depending on operation conditions. Specifically, if the required capacity of the condenser (64, 65) is higher than the required capacity of the evaporator (61, 67), the rotational speed of the compressor (80) is controlled such that the condensation pressure approaches the target pressure. Thus, the condensation pressure can be promptly adjusted to the target pressure, and the required capacity of the condenser (64, 65) can be ensured.

If the required capacity of the evaporator (61, 67) is higher than the required capacity of the condenser (64, 65), the rotational speed of the compressor (80) is controlled such that the evaporation pressure approaches the target pressure. Thus, the evaporation pressure can be promptly adjusted to the target pressure, and the required capacity of the evaporator (61, 67) can be ensured.

A seventeenth aspect of the invention is intended for the dehumidification system of the fourteenth aspect of the invention, in which the refrigerant circuit (70*a*, 120) is a two-stage cascade refrigeration cycle type refrigerant circuit (120) including a high-pressure circuit (120*a*) in which a first compressor (130) and the recovery heat exchanger (65) are connected together to perform a refrigeration cycle, a low-pressure circuit (120*b*) in which a second compressor (150) and the outdoor air cooling heat exchanger (61) are connected together to perform a refrigeration cycle, and an intermediate heat exchanger (140) configured to exchange heat between low-pressure refrigerant of the high-pressure circuit (120*a*) and high-pressure refrigerant of the low-pressure circuit (120*b*).

In the seventeenth aspect of the invention, the high-pressure circuit (120*a*) connected to the recovery heat exchanger (65) and the low-pressure circuit (120*b*) connected to the outdoor air cooling heat exchanger (61) are connected together through the intermediate heat exchanger (140) to form the two-stage cascade refrigeration cycle type refrigerant circuit (120). Thus, a sufficient difference between the condensation pressure of the recovery heat exchanger (65) and the evaporation pressure of the outdoor air cooling heat exchanger (61) can be ensured. As a result, an air heating capacity of the recovery heat exchanger (65) increases, and an air cooling capacity of the outdoor air cooling heat exchanger (61) also increases.

Advantages of the Invention

According to the present disclosure, greater energy conservation can be realized as compared to that in a conventional system.

Specifically, cooling dehumidification is first performed in the first dehumidification unit (60). Since outdoor air which may contain a large amount of moisture is cooled and dehumidified within such a range that freezing does not occur, there are advantages that a cost is lower and that an energy consumption amount is relatively small.

The outdoor air dehumidified in the first dehumidification unit (60) still contains a large amount of moisture. Thus, if adsorption dehumidification is performed using the adsorption rotor (31) as in the conventional system, a high recovery temperature is required in the second dehumidification unit (20) due to adsorption heat generated upon dehumidification. For such a reason, in the present disclosure, cooling adsorption is performed using the adsorption heat exchangers (22, 24) to remove adsorption heat and to perform adsorption. Thus, while an increase in temperature can be reduced, air having a dew point of −10° C. to −20° C. can be obtained with a high efficiency.

Further, in the present disclosure, since air having a dew point of equal to or lower than −10° C. contains a small amount of moisture, the amount of adsorption heat generated upon adsorption in the third dehumidification unit (30) is small. Thus, an increase in temperature due to adsorption heat is not an obstructive factor for adsorption. Consequently, adsorption can be performed using the adsorption rotor (31) whose air contact area can be easily expanded as compared to the adsorption heat exchangers (22, 24), and a residence time per unit volume can be reduced. This results in efficient dehumidification.

According to the present disclosure, since the adsorption heat exchangers (22, 24) are used in the second dehumidification unit (20) to decrease the humidity and temperature of air, the recovery temperature of the adsorption rotor (31) can be decreased. That is, since combination of the adsorption heat exchangers (22, 24) of the second dehumidification unit (20) and the adsorption rotor (31) of the third dehumidification unit (30) allows low-temperature low-dew-point air to be supplied to the adsorption rotor (31) of the third dehumidification unit (30), little adsorption heat is generated even if a large amount of moisture adsorbs onto the adsorption rotor (31) to decrease the humidity of air. Thus, an increase in temperature of the adsorption rotor (31) is reduced. As a result, the recovery temperature can be decreased, and energy conservation and cost reduction can be realized.

Since the recovery temperature can be decreased, exhaust heat generated in, e.g., a manufacturing facility for lithium ion batteries can be used as energy for recovery of the adsorption rotor (31), and more energy conservation can be realized.

According to the second aspect of the invention, when air for recovery of the adsorption rotor (31) is heated by the air heater (65), the recovery temperature can be decreased as compared to a conventional recovery temperature. Thus, the amount of heat required for such heating can be decreased, and therefore energy conservation can be realized.

According to the third aspect of the invention, since the recovery heat exchanger (65) provided in the refrigerant circuit (70*a*, 120) configured to perform the refrigeration cycle and serving as the condenser is used as the air heater (65), recovery air to be supplied to the adsorption rotor (31) can be more efficiently heated, and therefore more energy conservation can be realized.

According to the fourth aspect of the invention, since heat taken from outdoor air by refrigerant in the outdoor air cooling heat exchanger (61) is used in the recovery heat exchanger (65) to recover the adsorption rotor (31), an energy efficiency upon recovery can be enhanced.

According to the fifth aspect of the invention, when air for recovery of the adsorption rotor (31) is heated by the air heater (65) such as the electrical heater or the steam heater, the recovery temperature can be decreased as compared to the conventional recovery temperature. Thus, the amount of heat required for such heating can be decreased, and therefore energy conservation can be realized.

According to the sixth aspect of the invention, since the adsorption heat exchanger (22, 24) on the adsorption side is upstream of the adsorption part (32) of the adsorption rotor (31), low-humidity low-temperature air can be supplied to the adsorption part (32) of the adsorption rotor (31). Thus, an increase in temperature of the adsorption rotor (31) can be reduced. Moreover, since heated air through the recovery part (34) of the adsorption rotor (31) is supplied to the adsorption heat exchanger (22, 24) on the recovery side, such air can be also used for recovery of the adsorption heat exchanger (22, 24) on the recovery side.

According to the seventh aspect of the invention, the configuration in which the adsorption heat exchangers (22, 24) are provided in the second dehumidification unit (20) such that each adsorption heat exchanger (22, 24) is alternately switched to the adsorption side or the recovery side is employed, and such a configuration is combined with the third dehumidification unit (30) using the adsorption rotor (31). Thus, the system configured to continuously perform dehumidification can be easily realized.

According to the eighth aspect of the invention, since dehumidified air cooled in the second dehumidification unit (20) is supplied to the third dehumidification unit (30) without the air passing through the intermediate cooler, energy required for cooling of air by the intermediate cooler which has been generally used in the conventional system is saved. Moreover, since cooling and dehumidification of air are performed in the second dehumidification unit (20) of the present disclosure, the configuration without the intermediate cooler can be realized. Thus, more energy conservation and more cost reduction can be realized.

According to the ninth aspect of the invention, since air returning from the indoor space (S) to the air supply passage (40) through the return air passage (58) is used in addition to air having passed through the second dehumidification unit (20), low-humidity low-temperature air can be supplied to the adsorption part (32) of the adsorption rotor (31).

According to the tenth aspect of the invention, since the return air fan (59) configured to push indoor air toward the air supply passage (40) is provided in the return air passage (58), the return air passage (58) and part of the air supply passage (40) communicating with the return air passage (58) are under a positive pressure. Since such a part of the system is maintained at the positive pressure, entry of moisture into the air supply passage (40) can be reduced or prevented. Thus, performance of the system can be enhanced.

According to the eleventh aspect of the invention, since the return air cooler (67) configured to cool air flowing through the return air passage (58) is provided in the return air passage (58), cooled return air can be sent back to the air supply passage (40), and air to be supplied can be maintained at a low temperature after such air joins the return air. Thus, air to be supplied to the adsorption rotor (31) is maintained at a low temperature, and therefore the recovery temperature of the adsorption rotor (31) can be suppressed at a low level. The amount of heat required for recovery can be reduced, and energy conservation can be realized.

According to the twelfth aspect of the invention, the adsorbent provided on the adsorption heat exchangers (22, 24) is the adsorbent showing the adsorption isotherm indicating that a higher relative humidity of air results in a greater adsorption amount per unit increment of the relative humidity, and the adsorbent provided on the adsorption rotor (31) is the adsorbent showing the adsorption isotherm indicating that a lower relative humidity of air results in a greater adsorption amount per unit increment of the relative humidity. Thus, a dehumidification effect suitable for each of the adsorption heat exchangers (22, 24) and the adsorption rotor (31) can be obtained, and a system efficiency can be enhanced.

According to the thirteenth aspect of the invention, in the existing system including the first dehumidification unit (60) and the third dehumidification unit (30), the second dehumidification unit (20) is connected between the first dehumidification unit (60) and the third dehumidification unit (30). Thus, the three-stage dehumidification system capable of performing low-temperature recovery can be realized using the existing system. Consequently, energy conservation in the existing system can be realized.

According to the fourteenth aspect of the invention, since the reheat heat exchanger (64) and the return air cooling heat exchanger (67) are connected to the refrigerant circuit (70*a*, 120), heat taken from air in the return air cooling heat exchanger (67) can be used for heating of air in the reheat heat exchanger (64). As a result, energy conservation in the dehumidification system can be further improved.

According to the fifteenth aspect of the invention, since the condenser (64, 65) and the evaporator (61, 67) are connected to the single refrigerant circuit (70*a*), simplification of the refrigerant circuit (70*a*) and cost reduction can be realized.

According to the sixteenth aspect of the invention, if the required capacity of the condenser (64, 65) is insufficient, the condensation pressure can be promptly adjusted to the target pressure, and therefore the required capacity of the condenser (64, 65) can be ensured. If the required capacity of the evaporator (61, 67) is insufficient, the evaporation pressure can be promptly adjusted to the target pressure, and therefore the required capacity of the evaporator (61, 67) can be ensured.

According to the seventeenth aspect of the invention, since the two-stage cascade refrigeration cycle type refrigerant circuit (120) is used, a sufficient differential pressure between the recovery heat exchanger (65) and the outdoor air cooling heat exchanger (61) can be ensured. As a result, sufficient capacities of both of the recovery heat exchanger (65) and the outdoor air cooling heat exchanger (61) can be ensured.

BRIEF DESCRIPTION OF THE DRAWINGS

FIG. 10(A) illustrates a first operation. FIG. 10(B) illustrates a second operation.

DESCRIPTION OF EMBODIMENTS

An embodiment of the present disclosure will be described in detail below with reference to drawings.

The embodiment of the present disclosure is intended for a dehumidification system (10) configured to dehumidify an indoor space (S). The dehumidification system (10) dehumidifies outdoor air (OA) to supply such air to the inside of a room as supply air (SA). The indoor space (S) targeted for dehumidification is a dry clean area, for which low-dew-point air is required, in a manufacturing line for lithium ion batteries, and the dehumidification system (10) illustrated in FIG. 1 forms part of the manufacturing line for lithium-ion batteries.

Figure 1:
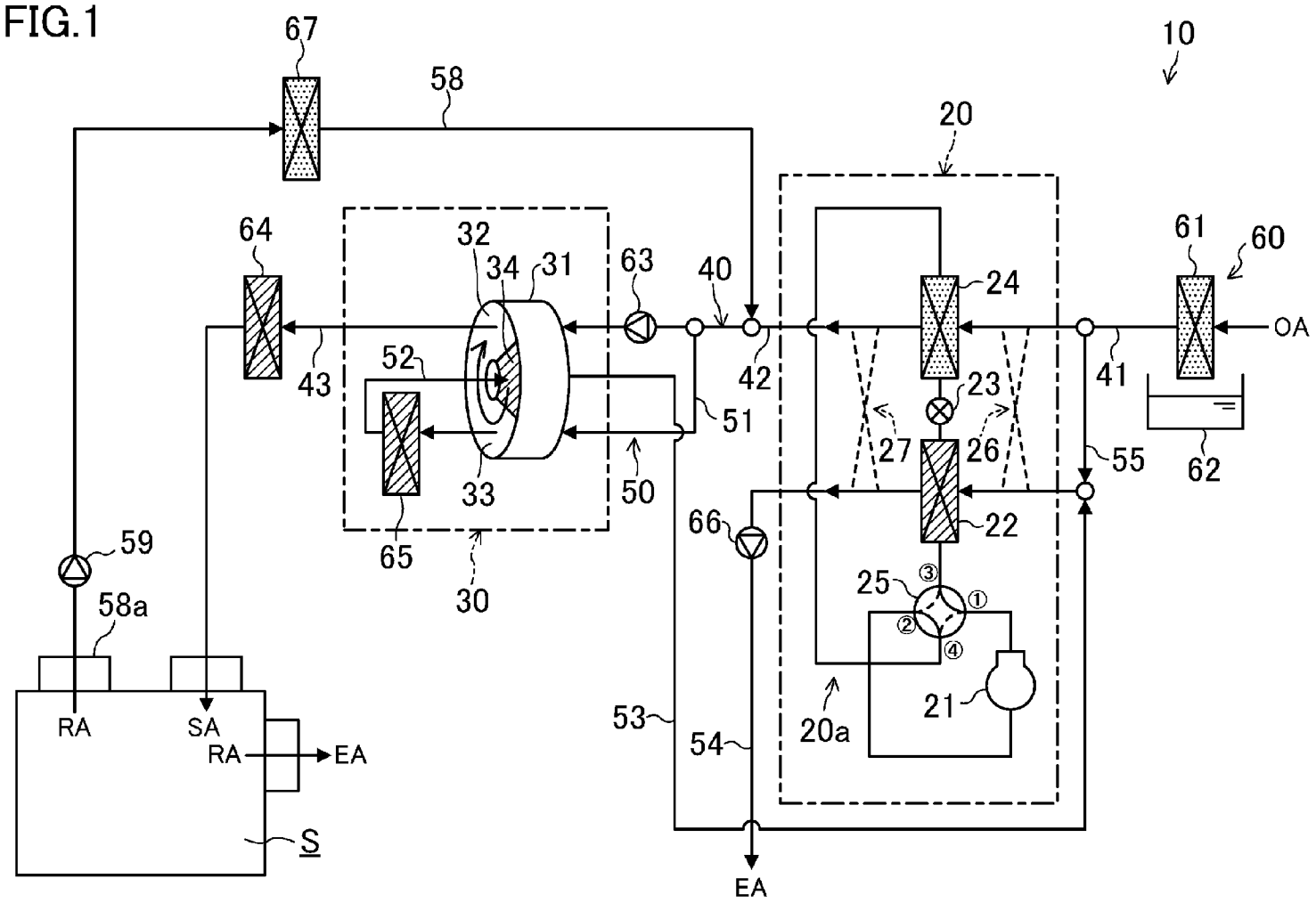
FIG. 1 is a schematic configuration diagram illustrating an entire configuration of a dehumidification system of an embodiment in which dehumidification units are in a first operation.

Referring to FIG. 1, the dehumidification system (10) includes a first dehumidification unit (60), a second dehumidification unit (20), and a third dehumidification unit (30).

The dehumidification system (10) further includes an air supply passage (40) through which dehumidified outdoor air (OA) is supplied to the inside of the room as supply air (SA). The air supply passage (40) includes first to third air supply paths (41, 42, 43). The first air supply path (41) is formed upstream of the second dehumidification unit (20). The second air supply path (42) is formed between the second dehumidification unit (20) and the third dehumidification unit (30), and directly connects between the second dehumidification unit (20) and the third dehumidification unit (30) without an intermediate cooler being provided therebetween. The third air supply path (43) is formed downstream of the third dehumidification unit (30).

The dehumidification system (10) still further includes an air discharge passage (50) through which part of air of the air supply passage (40) is discharged to the outside of the room as exhaust air (EA). The air discharge passage (50) includes first to fourth air discharge paths (51, 52, 53, 54). The air discharge passage (50) is, at an inlet end thereof, connected to the second air supply path (42), and communicates, at an outlet end thereof, with the outside of the room.

The air supply passage (40) is a passage through which air to be supplied to the indoor space (S) passes, and the air discharge passage (50) is a passage through which air to be discharged to the outside of the room passes. The air supply passage (40) and the air discharge passage (50) forms an air passage (40, 50). In the air passage (40, 50), the first dehumidification unit (60), the second dehumidification unit (20), and the third dehumidification unit (30) are arranged in this order from an inlet of outdoor air to be supplied to the inside of the room.

The first dehumidification unit (60) includes an outdoor air cooling heat exchanger (61) configured to cool and dehumidify outdoor air, and a drain pan (62) configured to collect water condensed in the outdoor air cooling heat exchanger (61). The outdoor air cooling heat exchanger (61) is provided in the first air supply path (41). In the second air supply path (42), an air supply fan (63) configured to deliver air to the inside of the room is provided. In the third air supply path (43), a reheat heat exchanger (64) configured to heat air is provided.

The second dehumidification unit (20) includes a dehumidification refrigerant circuit (20*a*) in which a compressor (21), a first adsorption heat exchanger (22), an expansion valve (23), a second adsorption heat exchanger (24), and a four-way valve (25) are connected together. Such components are housed in a casing which is not shown in the figure. The dehumidification refrigerant circuit (20*a*) serves as a heating medium circuit in which refrigerant circulates as a heating medium. Each adsorption heat exchanger (22, 24) is a fin-and-tube heat exchanger on which an adsorbent is supported. In the casing, a housing chamber where the first adsorption heat exchanger (22) is housed and a housing chamber where the second adsorption heat exchanger (24) is housed are formed (not shown in the figure).

The four-way valve (25) has first to fourth ports. The first port is connected to a discharge side of the compressor (21), the second port is connected to a suction side of the compressor (21), the third port is connected to an end part of the first adsorption heat exchanger (22), and the fourth port is connected to an end part of the second adsorption heat exchanger (24). The four-way valve (25) is configured to be switchable between a first state (i.e., the state indicated by a solid line in FIG. 1) in which the first and third ports communicate with each other and the second and fourth ports communicate with each other, and a second state (i.e., the state indicated by a dashed line in FIG. 1) in which the first and fourth ports communicate with each other and the second and third ports communicate with each other.

The second dehumidification unit (20) further includes a first flow path switcher (26) configured to change a flow of air into the adsorption heat exchangers (22, 24), and a second flow path switcher (27) configured to change a flow of air from the adsorption heat exchangers (22, 24). Each flow path switcher (26, 27) includes a plurality of openable dampers. Each flow path switcher (26, 27) is configured to switch an air flow between the state indicated by a solid line in FIG. 1 and the state indicated by a solid line in FIG. 2.

As just described, the second dehumidification unit (20) is a dehumidification unit which includes, as a refrigerant flow path switching mechanism (25), the four-way valve (25) configured to alternately switch the adsorption heat exchangers (22, 24) provided in the refrigerant circuit (20*a*) between a dehumidification side and a recovery side, and which further includes, as an air passage switching mechanism (26, 27), the first and second flow path switchers (26, 27) configured to switch the air passage such that the adsorption heat exchanger serving as an evaporator is connected to the air supply passage (40) and that the adsorption heat exchanger serving as a condenser is connected to the air discharge passage (50).

The third dehumidification unit (30) includes an adsorption rotor (31) and a recovery heat exchanger (air heater) (65). The adsorption rotor (31) is configured such that an adsorbent is supported on a surface of a discoid porous base. The adsorption rotor (31) is disposed so as to extend over both of the air supply passage (40) and the air discharge passage (50). Moreover, the adsorption rotor (31) is driven by a drive mechanism (not shown in the figure), and is rotatable about a shaft center positioned between the air passages (40, 50).

A first adsorption part (32) through which air flowing through the third air supply path (43) of the air supply passage (40) passes, a second adsorption part (33) through which air flowing through the first air discharge path (51) of the air discharge passage (50) passes, and a recovery part (34) through which air flowing through the second air discharge path (52) of the air discharge passage (50) passes are formed in the adsorption rotor (31). Moisture contained in air adsorbs onto the first adsorption part (32) and the second adsorption part (33), and moisture contained in the adsorbent is dissipated from the recovery part (34) to air.

The first air discharge path (51) is formed upstream of the second adsorption part (33) of the adsorption rotor (31). The second air discharge path (52) is formed between the second adsorption part (33) of the adsorption rotor (31) and the recovery part (34) of the adsorption rotor (31). The third air discharge path (53) is formed between the recovery part (34) of the adsorption rotor (31) and the second dehumidification unit (20). The fourth air discharge path (54) is formed downstream of the second dehumidification unit (20).

In the second air discharge path (52), the recovery heat exchanger (65) configured to heat air for recovery of the adsorption rotor (31) is provided on a suction side of air for recovery of the adsorption rotor (31). In the fourth air discharge path (54), an air discharge fan (66) configured to release air to the outside of the room is provided. The third air discharge path (53) is connected to the first air supply path (41) through a branched path (55).

The dehumidification system (10) further includes a return air passage (58) through which indoor air (RA) is sent back to the air supply passage (40). The return air passage (58) is, at an inlet end thereof, connected to a return air port (58*a*) communicating with the indoor space (S), and is, at an outlet end thereof, connected to the second air supply path (42). That is, the outlet end of the return air passage (58) is connected to part of the air supply passage (40) between the second dehumidification unit (20) and the adsorption rotor (31). Moreover, the outlet end of the return air passage (58) is positioned upstream of the inlet end of the air discharge passage (50). A return air fan (59) configured to send indoor air to the air supply passage (40), and a return air cooling heat exchanger (return air cooler) (67) serving as an air cooler are provided in the return air passage (58).

Figure 4:
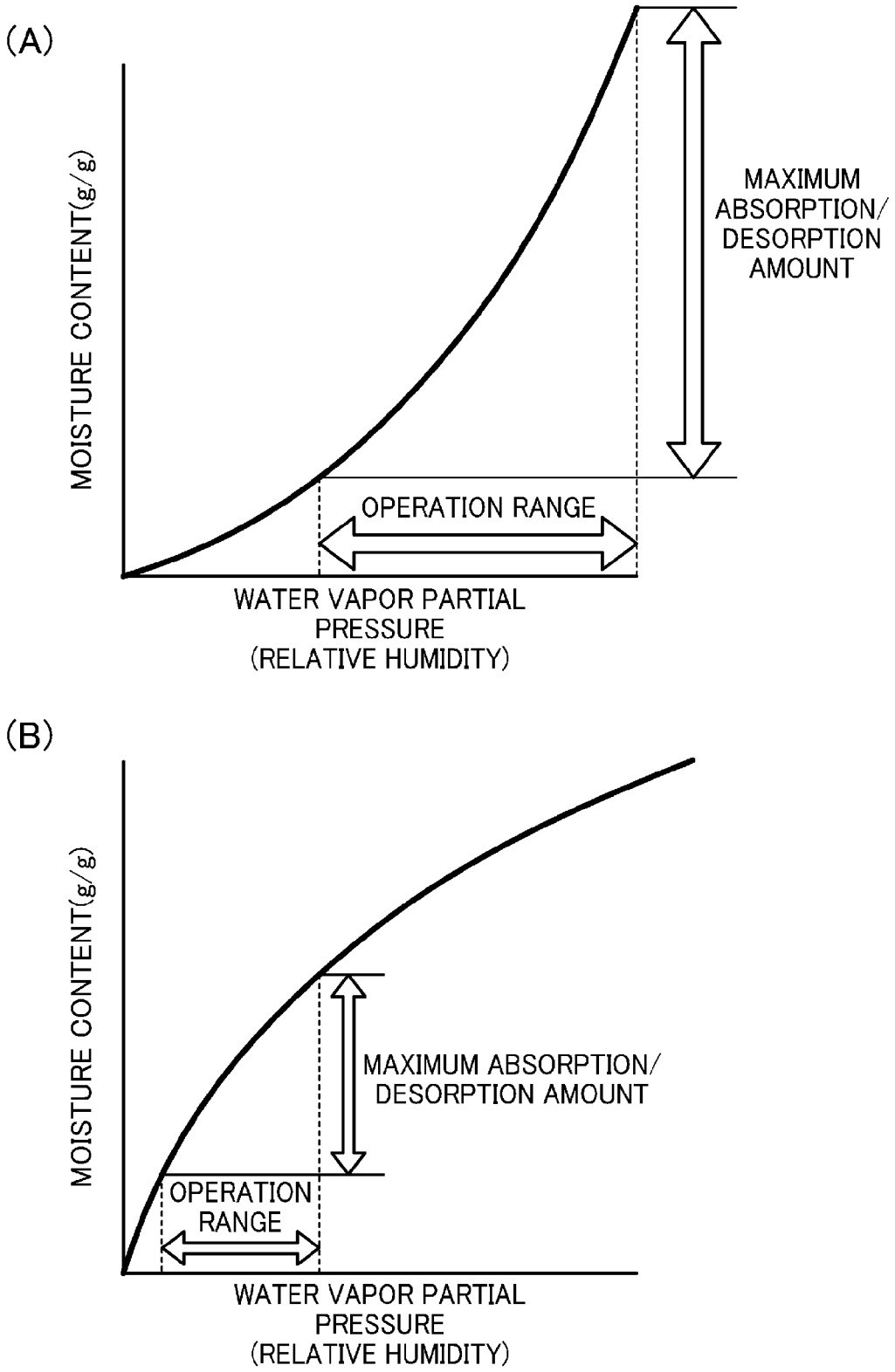
FIG. 4(A) is a graph showing an adsorption isotherm of an adsorbent used for an adsorption heat exchanger.
FIG. 4(B) is a graph showing an adsorption isotherm of an adsorbent used for an adsorption rotor.

Adsorbents having different characteristics are used for the adsorption heat exchangers (22, 24) and the adsorption rotor (31). Specifically, since the adsorbent is treated with a high water vapor partial pressure (relative humidity), an adsorbent, such as a polymeric sorbent and B-type silica gel, showing an adsorption isotherm curving downward relative to a positive gradient as illustrated in FIG. 4(A) is used for the adsorption heat exchangers (22, 24) positioned at a first stage. Moreover, since the adsorbent is treated with a low water vapor partial pressure (relative humidity), an adsorbent, such as A-type silica gel and zeolite, showing an adsorption isotherm curving upward relative to a positive gradient as illustrated in FIG. 4(B) is used for the adsorption rotor (31) positioned at a second stage. That is, an adsorbent having a high moisture content in the case of a relatively-high relative humidity and showing an adsorption isotherm indicating that a higher relative humidity of air results in a greater adsorption amount per unit increment of the relative humidity is selected for the adsorption heat exchangers (22, 24), whereas an adsorbent having a high moisture content in the case of a relatively-low relative humidity and showing an adsorption isotherm indicating that a lower relative humidity of air results in a greater adsorption amount per unit increment of the relative humidity is selected for the adsorption rotor (31).

Figure 5:
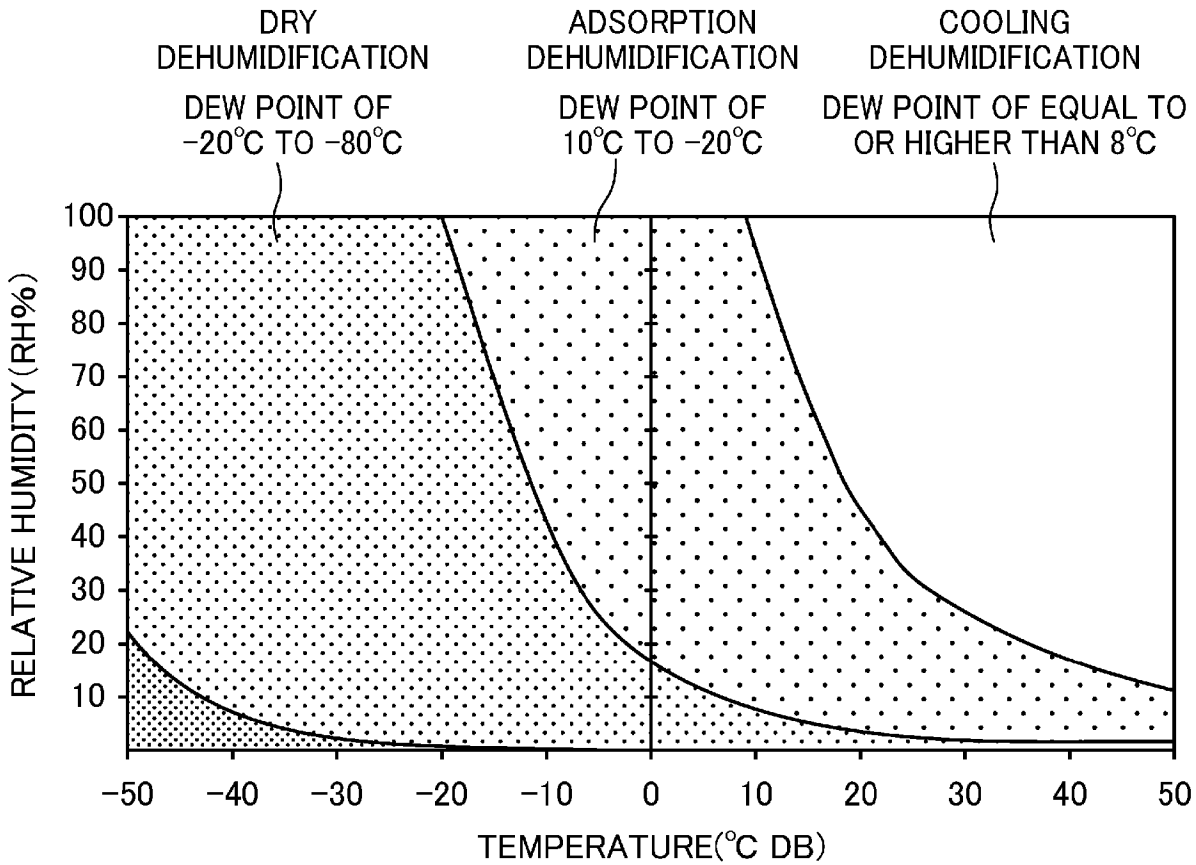
FIG. 5 is a graph showing a suitable range in dehumidification performed by each of first to third dehumidification units.

FIG. 5 is a graph showing a suitable temperature range in dehumidification performed by each dehumidification unit (60, 20, 30), where the horizontal axis represents a dry-bulb temperature and the vertical axis represents a relative humidity. The range where the dew point is equal to or higher than about 8° C. is suitable for cooling dehumidification performed by the outdoor air cooling heat exchanger (61) of the first dehumidification unit (60). The range where the dew point is about 10° C. to about −20° C. is suitable for adsorption dehumidification performed by the adsorption heat exchangers (22, 24) of the second dehumidification unit (20). The range where the dew point is about −20° C. to about −80° C. is suitable for dry dehumidification performed by the adsorption rotor (31) of the third dehumidification unit (30).

Figure 3:
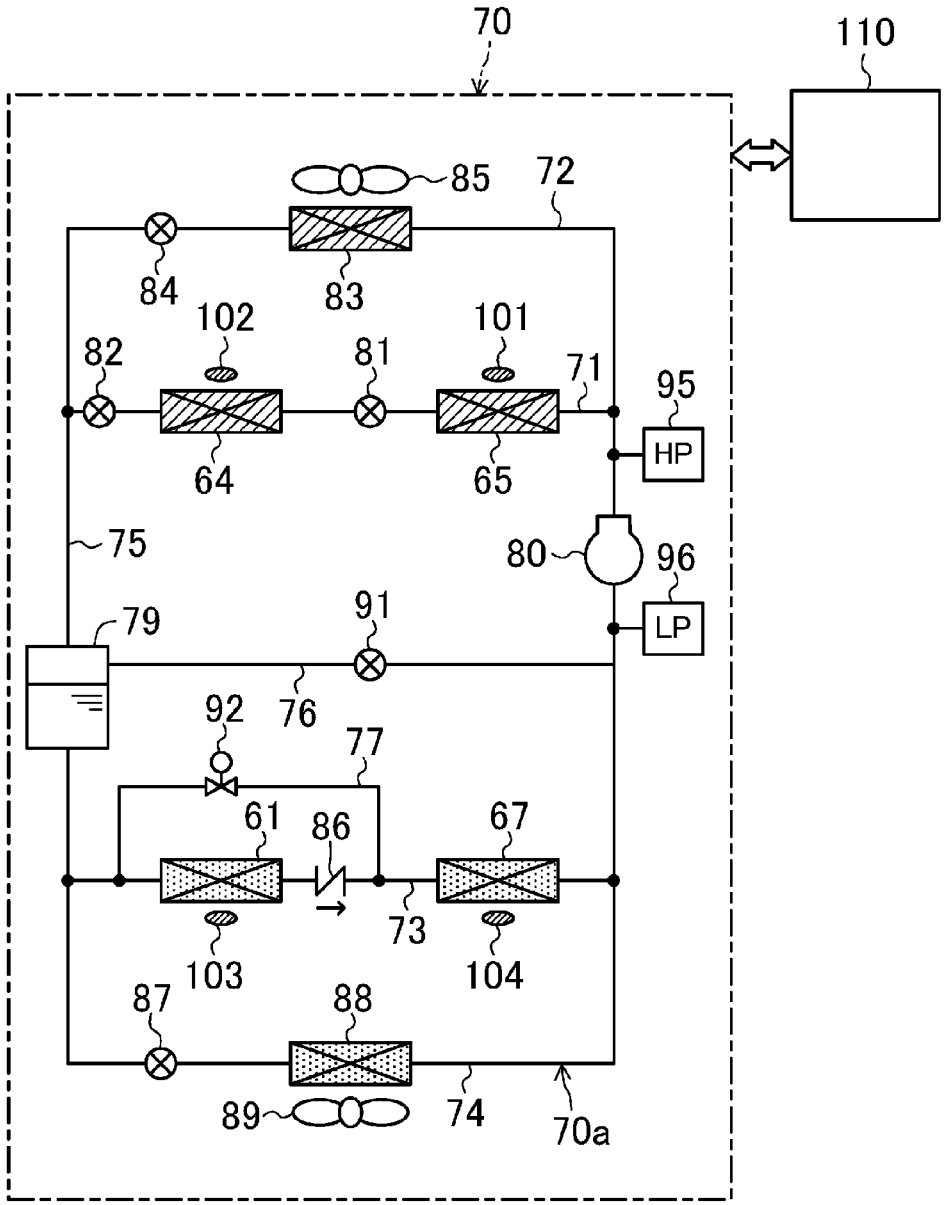
FIG. 3 is a piping diagram of a refrigerant circuit of the dehumidification system of the embodiment.

Referring to FIG. 3, the dehumidification system (10) of the present embodiment further includes a refrigerating unit (70) having a refrigerant circuit (70*a*) in which the heat exchangers (61, 64, 65, 67) are connected together. The refrigerant circuit (70*a*) of the present embodiment is a single-stage refrigeration cycle type refrigerant circuit in which refrigerant circulates through a single closed circuit.

A compressor (80) is connected to the refrigerant circuit (70*a*). The compressor (80) is a rotary fluid machine such as a rotary piston type machine, a swing piston type machine, and a scroll type machine. The compressor (80) is a variable displacement compressor configured such that the rotational speed thereof is adjusted by an inverter circuit.

The compressor (80) branches, on a discharge side thereof, into a first discharge line (71) and a second discharge line (72). The recovery heat exchanger (65), a first expansion valve (81), the reheat heat exchanger (64), and a second expansion valve (82) are connected to the first discharge line (71) in this order from the upstream side to the downstream side. A condensation pressure adjustment heat exchanger (83) and a third expansion valve (84) are connected to the second discharge line (72) in this order from the upstream side to the downstream side. A first outdoor fan (85) configured to send outdoor air is provided in the proximity of the condensation pressure adjustment heat exchanger (83).

The compressor (80) branches, on a suction side thereof, into a first suction line (73) and a second suction line (74). The outdoor air cooling heat exchanger (61), a check valve (86), the return air cooling heat exchanger (67) are connected to the first suction line (73) in this order from the upstream side to the downstream side. A bypass pipe (71) bypassing the outdoor air cooling heat exchanger (61) and the check valve (86) is connected to the first suction line (73). A solenoid on-off valve (92) is provided in the bypass pipe (77). A fourth expansion valve (87) and an evaporation pressure adjustment heat exchanger (88) are connected to the second suction line (74) in this order from the upstream side to the downstream side. A second outdoor fan (89) configured to send outdoor air is provided in the proximity of the evaporation pressure adjustment heat exchanger (88).

A single joint pipe (75) is connected between an outlet end of the discharge line (71, 72) and an inlet end of the suction line (73, 74). A gas-liquid separator (79) is provided in the joint pipe (75). An inlet end of an injection pipe (76) is connected to a gas phase part of the gas-liquid separator (79). An outlet end of the injection pipe (76) is connected to a suction pipe of the compressor (80). A fifth expansion valve (91) is provided in the injection pipe (76).

The recovery heat exchanger (65), the reheat heat exchanger (64), and the condensation pressure adjustment heat exchanger (83) form a condenser configured such that refrigerant is condensed by dissipating heat to air. The outdoor air cooling heat exchanger (61), the return air cooling heat exchanger (67), and the evaporation pressure adjustment heat exchanger (88) form an evaporator configured such that refrigerant is evaporated by absorbing heat from air. Each expansion valve (81, 82, 84, 87, 91) is, e.g., an electronic expansion valve, and forms a pressure reduction mechanism configured to adjust the pressure of refrigerant.

The dehumidification system (10) further includes various sensors. Specifically, the dehumidification system (10) further includes a high-pressure sensor (95) configured to detect the high pressure (condensation pressure) of the refrigerant circuit (70*a*), and a low-pressure sensor (96) configured to detect the low pressure (evaporation pressure) of the refrigerant circuit (70*a*). Moreover, the dehumidification system (10) still further includes a load detection unit configured to detect a capacity required for each of the recovery heat exchanger (65), the reheat heat exchanger (64), the outdoor air cooling heat exchanger (61), and the return air cooling heat exchanger (67). The load detection unit includes, e.g., a first air temperature sensor (101)

configured to detect an air temperature downstream of the recovery heat exchanger (65), a second air temperature sensor (102) configured to detect an air temperature downstream of the reheat heat exchanger (64), a third air temperature sensor (103) configured to detect an air temperature downstream of the outdoor air cooling heat exchanger (61), and a fourth air temperature sensor (104) configured to detect an air temperature downstream of the return air cooling heat exchanger (67).

The dehumidification system (10) further includes a controller (110). The controller (110) is configured to control, e.g., the rotational speed of the compressor (80), the opening degree of each expansion valve (81, 82, 84, 87, 91), and the amount of air sent by each outdoor fan (85, 89) based on detection values of the foregoing sensors or various set values input by a user.

Operation

Operation of the dehumidification system (10) will be described.

<Basic Operation of Second Dehumidification Unit>

Figure 2:
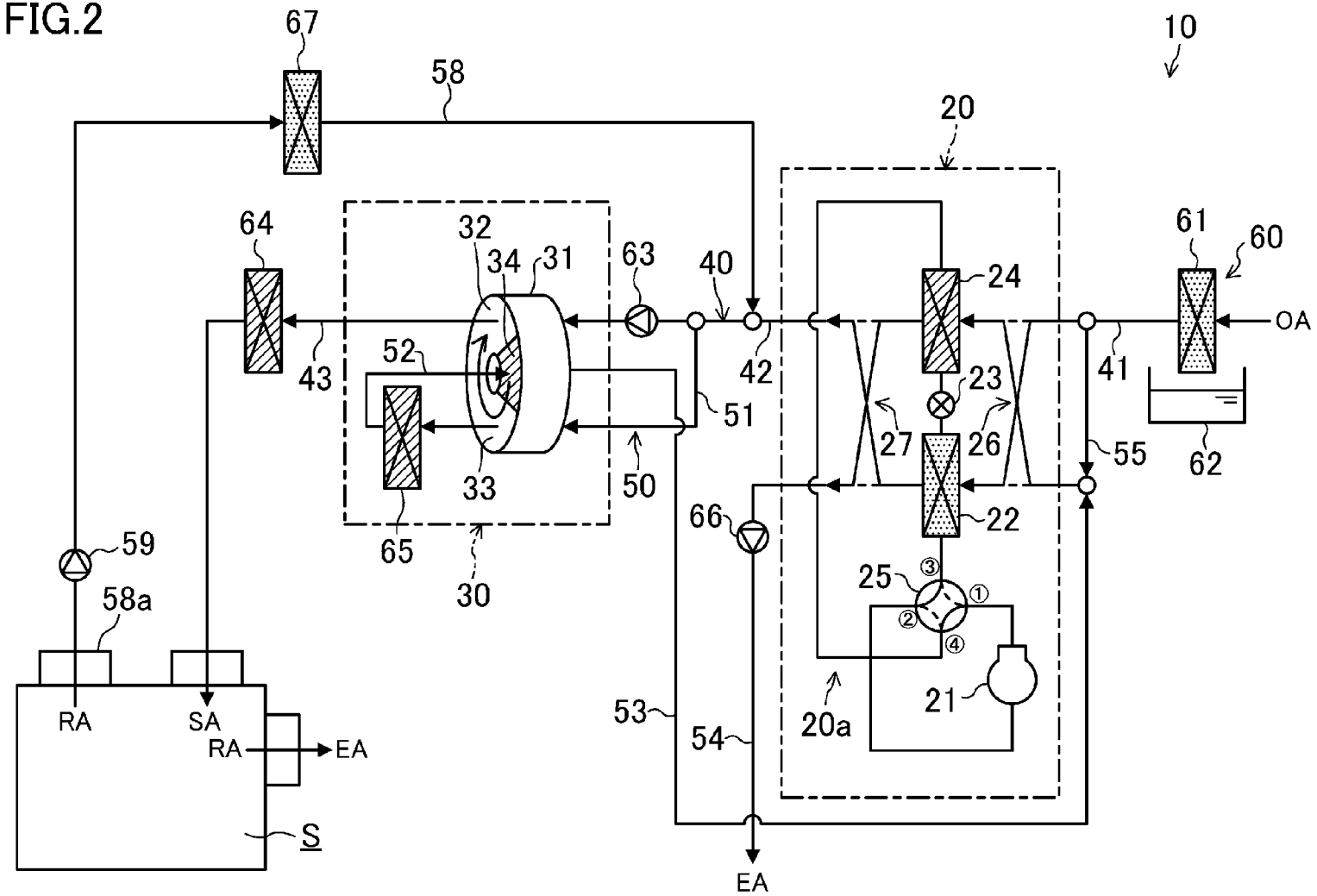
FIG. 2 is a schematic configuration diagram illustrating the entire configuration of the dehumidification system of the embodiment in which the dehumidification units are in a second operation.

In the operation of the dehumidification system (10), the second dehumidification unit (20) alternately performs a first operation illustrated in FIG. 1 and a second operation illustrated in FIG. 2 at predetermined time intervals (e.g., at intervals of 5 minutes).

In the first operation, while air is being dehumidified in the second adsorption heat exchanger (24), the adsorbent of the first adsorption heat exchanger (22) is being recovered.

Specifically, during the first operation, in the dehumidification refrigerant circuit (20*a*), the four-way valve (25) is in the state illustrated in FIG. 1, and the opening degree of the expansion valve (23) is set to a predetermined opening degree. The first flow path switcher (26) causes the first air supply path (41) and the housing chamber (not shown in the figure) of the second adsorption heat exchanger (24) to communicate with each other, and causes the third air discharge path (53) and the housing chamber (not shown in the figure) of the first adsorption heat exchanger (22) to communicate with each other. Moreover, the second flow path switcher (27) causes the housing chamber of the second adsorption heat exchanger (24) and the second air supply path (42) to communicate with each other, and causes the housing chamber of the first adsorption heat exchanger (22) and the fourth air discharge path (54) to communicate with each other.

In the first operation, refrigerant compressed in the compressor (21) flows into the first adsorption heat exchanger (22) through the four-way valve (25). In the first adsorption heat exchanger (22), the adsorbent is heated by the refrigerant, and moisture contained in the adsorbent is dissipated to air. The pressure of the refrigerant condensed by dissipating heat in the first adsorption heat exchanger (22) is reduced by the expansion valve (23), and then the refrigerant flows into the second adsorption heat exchanger (24). In the second adsorption heat exchanger (24), moisture contained in air adsorbs onto the adsorbent, and adsorption heat generated thereupon is provided to the refrigerant. The refrigerant evaporated by absorbing heat in the second adsorption heat exchanger (24) is sucked into the compressor (21), and then is compressed.

In the second operation, while air is being dehumidified in the first adsorption heat exchanger (22), the adsorbent of the second adsorption heat exchanger (24) is being recovered.

During the second operation, in the dehumidification refrigerant circuit (20*a*), the four-way valve (25) is in the state illustrated in FIG. 2, and the opening degree of the expansion valve (23) is set to a predetermined opening degree. The first flow path switcher (26) causes the first air supply path (41) and the housing chamber (not shown in the figure) of the first adsorption heat exchanger (22) to communicate with each other, and causes the third air discharge path (53) and the housing chamber (not shown in the figure) of the second adsorption heat exchanger (24) to communicate with each other. Moreover, the second flow path switcher (27) causes the housing chamber of the first adsorption heat exchanger (22) and the second air supply path (42) to communicate with each other, and causes the housing chamber of the second adsorption heat exchanger (24) and the fourth air discharge path (54) to communicate with each other.

In the second operation, refrigerant compressed in the compressor (21) flows into the second adsorption heat exchanger (24) through the four-way valve (25). In the second adsorption heat exchanger (24), the adsorbent is heated by the refrigerant, and moisture contained in the adsorbent is dissipated to air. The pressure of the refrigerant condensed by dissipating heat in the second adsorption heat exchanger (24) is reduced by the expansion valve (23), and then the refrigerant flows into the first adsorption heat exchanger (22). In the first adsorption heat exchanger (22), moisture contained in air adsorbs onto the adsorbent, and adsorption heat generated thereupon is provided to the refrigerant. The refrigerant evaporated by absorbing heat in the first adsorption heat exchanger (22) is sucked into the compressor (21), and then is compressed.

<Basic Operation of Refrigerating Unit>

In the operation of the dehumidification system (10), a refrigeration cycle is performed in the refrigerating unit (70). In basic operation of the refrigerating unit (70), the opening degrees of the first expansion valve (81), the second expansion valve (82), and the fifth expansion valve (91) are properly adjusted, and the third expansion valve (84) and the fourth expansion valve (87) are in a fully-closed state. Moreover, the first outdoor fan (85) and the second outdoor fan (89) are stopped.

Refrigerant compressed in the compressor (80) is sent to the first discharge line (71), and flows into the recovery heat exchanger (65). In the recovery heat exchanger (65), the refrigerant is condensed by dissipating heat to air. The pressure of the refrigerant condensed in the recovery heat exchanger (65) is reduced to a lowered pressure by the first expansion valve (81), and then such refrigerant flows into the reheat heat exchanger (64). In the reheat heat exchanger (64), the refrigerant is condensed by dissipating heat to air. The pressure of the refrigerant condensed in the reheat heat exchanger (64) is reduced to a low pressure by the second expansion valve (82), and then such refrigerant passes through a gas-liquid separator (90). Subsequently, the refrigerant is sent to the first suction line (73). Note that the opening degree of the second expansion valve (82) is controlled using the superheat degree of refrigerant on the suction side of the compressor (80).

The refrigerant sent to the first suction line (73) flows into the outdoor air cooling heat exchanger (61). In the outdoor air cooling heat exchanger (61), the refrigerant is evaporated by absorbing heat from air. The refrigerant evaporated in the outdoor air cooling heat exchanger (61) flows into the return air cooling heat exchanger (67) through the check valve (86). In the return air cooling heat exchanger (67), the refrigerant is evaporated by absorbing heat from air. The refrigerant evaporated in the return air cooling heat exchanger (67) is sucked into the compressor (80), and then is compressed.

<Operation of Dehumidification System>

Next, the operation of the dehumidification system (10) will be described. In the operation of the dehumidification system (10), the second dehumidification unit (20) alternately performs the first and second operations. Moreover, the air supply fan (63), the air discharge fan (66), and the return air fan (59) are operated.

Outdoor air (OA) flows into the first air supply path (41) of the air supply passage (40). Such air is a relatively high-temperature high-humidity air. The air flowing through the first air supply path (41) is cooled by the outdoor air cooling heat exchanger (61) of the first dehumidification unit (60). Condensation water generated from the air during cooling is collected to the drain pan (62). In the first operation, the air cooled and dehumidified in the outdoor air cooling heat exchanger (61) passes through the second adsorption heat exchanger (24) of the second dehumidification unit (20). In the second adsorption heat exchanger (24), moisture contained in the air adsorbs onto the adsorbent. In the second operation, the air cooled and dehumidified in the outdoor air cooling heat exchanger (61) is dehumidified in the first adsorption heat exchanger (22) of the second dehumidification unit (20).

Adsorption heat generated when moisture adsorbs onto the adsorbent in the adsorption heat exchanger (22, 24) is provided to refrigerant flowing through the adsorption heat exchanger (22, 24). Since air flowing through the air supply passage (40) is subject to cooling using refrigerant, such air is dehumidified so as to have a reduced humidity, and is cooled so as to have a reduced temperature.

The air dehumidified in the second dehumidification unit (20) flows through the second air supply path (42), and then passes through the first adsorption part (32) of the adsorption rotor (31). As a result, moisture contained in the air adsorbs onto the adsorbent of the adsorption rotor (31). The temperature of the air dehumidified in the adsorption rotor (31) is adjusted in the reheat heat exchanger (64), and then such air is supplied to the inside of the room as supply air (SA).

Part of the air flowing through the second air supply path (42) flows into the air discharge passage (50), and then passes through the second adsorption part (33) of the adsorption rotor (31). As a result, moisture contained in the air adsorbs onto the adsorbent of the adsorption rotor (31). The second adsorption part (33) is on the way from the recovery part (34) through which high-temperature recovery air have passed to the first adsorption part (32), and is cooled in such a manner that the air of the second air supply path (42) flows through the second adsorption part (33).

The air dehumidified in the second adsorption part (33) of the adsorption rotor (31) flows through the second air discharge path (52), and then is heated in the recovery heat exchanger (65). The heated air passes through the recovery part (34) of the adsorption rotor (31). As a result, moisture contained in the adsorbent of the adsorption rotor (31) is provided to the air, and the adsorbent is recovered accordingly. The air used for recovery of the adsorption rotor (31) flows through the third air discharge path (53), and then joins air sent from the branched path (55).

In the first operation, such air passes through the first adsorption heat exchanger (22) of the second dehumidification unit (20). In the first adsorption heat exchanger (22), moisture contained in the adsorbent is provided to the air, and the adsorbent is recovered accordingly. The air used for recovery of the adsorbent of the first adsorption heat exchanger (22) flows through the fourth air discharge path (54), and then is discharged to the outside of the room as exhaust air (EA). In the second operation, the air recovers the adsorbent of the second adsorption heat exchanger (24), and then is discharged to the outside of the room as exhaust air (EA). As just described, in the present embodiment, air after recovery of the adsorption rotor (31) is also used for recovery of the adsorption heat exchanger (22, 24).

Part of air of the indoor space (S) is discharged to the outside of the room as exhaust air (EA), and the remaining part of the air of the indoor space (S) flows into the return air passage (58). The air flowing through the return air passage (58) is cooled by the return air cooling heat exchanger (67), and then returns to the second air supply path (42). The return air joins the air dehumidified in the second dehumidification unit (20). The air sent back from the indoor space (S) has a temperature lower than that of the air dehumidified in the second dehumidification unit (20). Since the air dehumidified in the second dehumidification unit (20) joins the return air, the temperature and humidity of the air dehumidified in the second dehumidification unit (20) are further reduced. Accordingly, a moisture adsorption capacity of the adsorption rotor (31) is improved.

The air flowing through the return air passage (58) is pushed into the second air supply path (42) by the return air fan (59). In the configuration in which indoor air is, without providing the return air fan (59), sucked into the second air supply path (42) only by the air supply fan (63), there is a possibility that high-humidity outdoor air is sucked from the outside of a duct to increase the humidity of supply air (SA). In the present embodiment, since air is pushed into the second air supply path (42) by the return air fan (59), the system is under a positive pressure, and suction of high-humidity outdoor air is reduced or prevented. Thus, an increase in humidity of supply air (SA) can be reduced or prevented.

<Energy Conservation in Dehumidification System>

Figure 6:
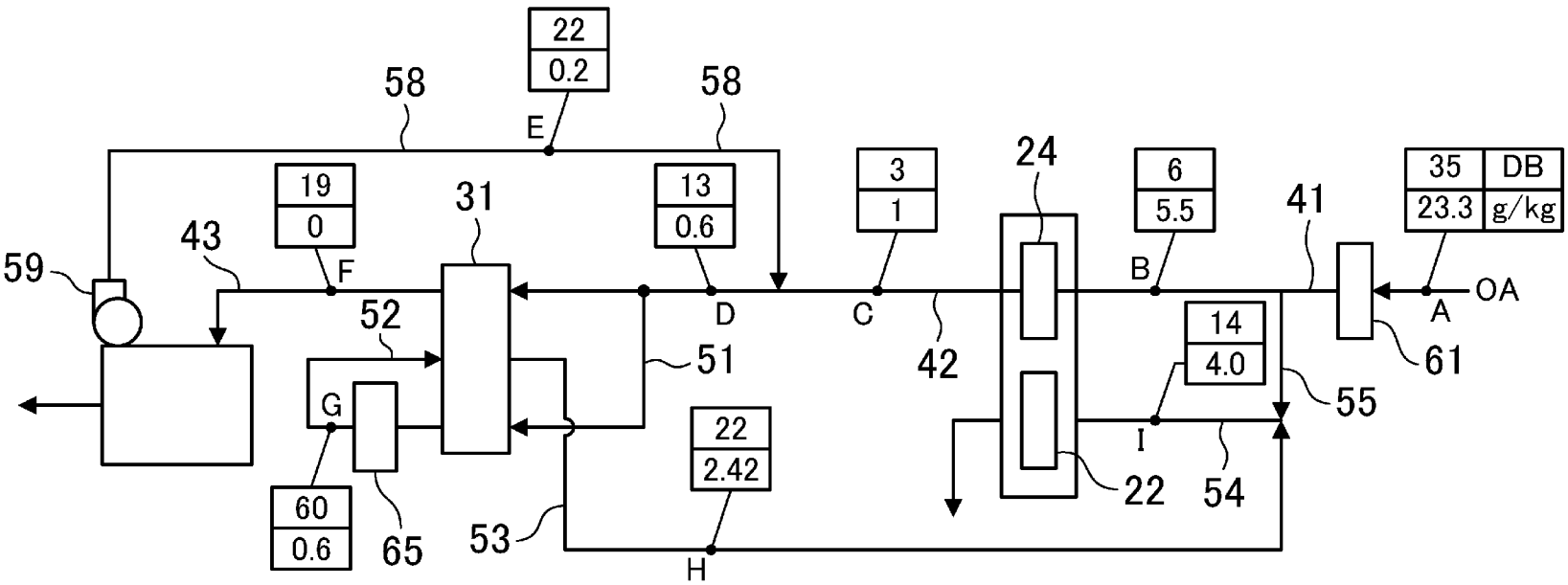
FIG. 6 is a schematic diagram illustrating operation of the dehumidification system of the embodiment.
Figure 7:
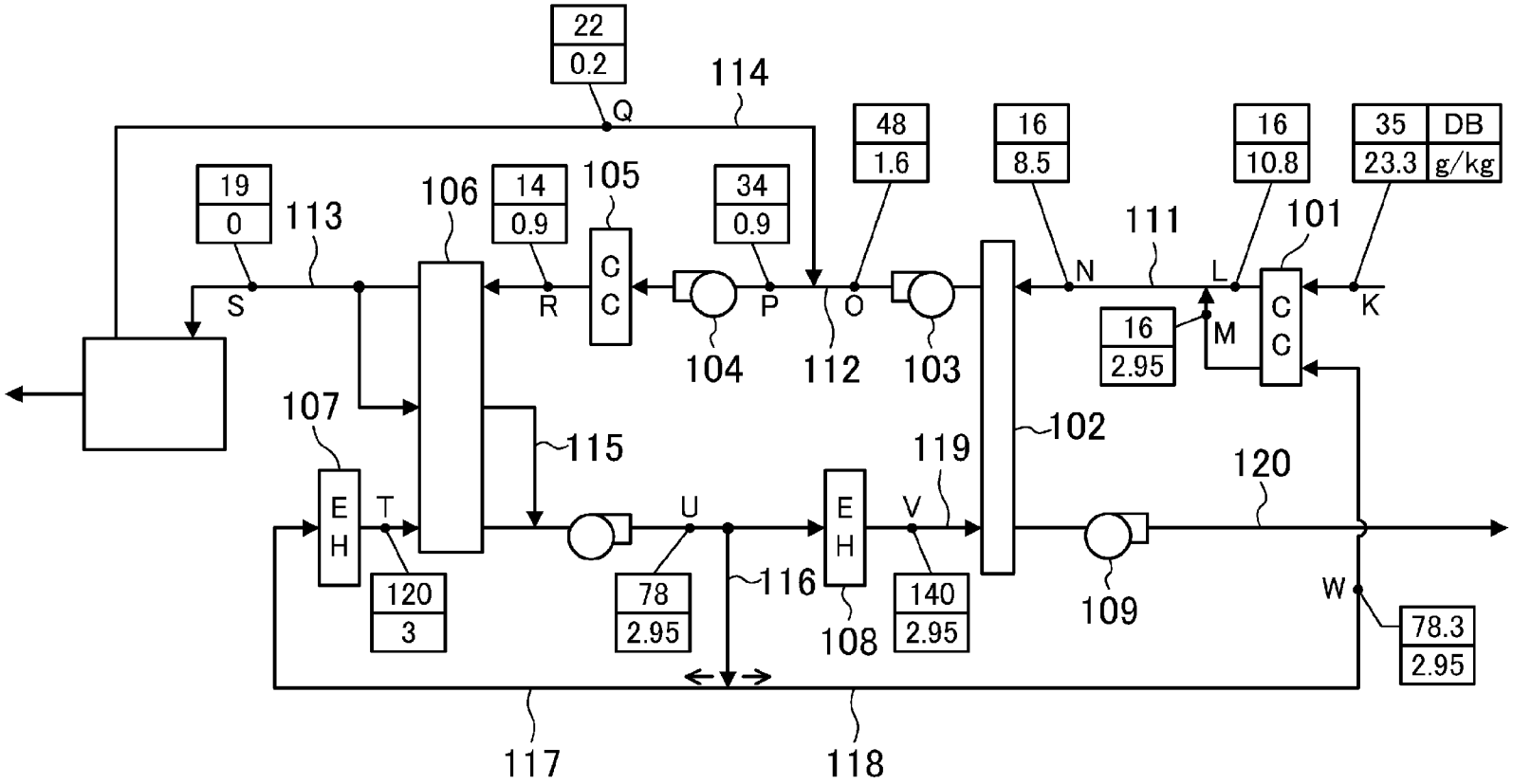
FIG. 7 is a schematic diagram illustrating operation of a dehumidification system of a comparative example.

FIG. 6 is a schematic diagram of the dehumidification system of the present embodiment, and FIG. 7 is a schematic diagram of a two-stage dehumidification system of a comparative example where adsorption rotor type dehumidification units are arranged at a subsequent stage of a first dehumidification unit for cooling dehumidification. In FIGS. 6 and 7, each point indicated by a capitalized alphabet character is illustrated with a dry-bulb temperature (° C.) on an upper side and a water vapor amount (g/Kg) on a lower side.

Comparative Example

In the comparative example, reference numerals (101)-(109) are assigned to circuit components, and reference numerals (111)-(120) are assigned to air passages.

In the comparative example, outdoor air (see point K) having a dry-bulb temperature of 35° C. and a water vapor amount of 23.3 g/Kg is cooled and dehumidified in an outdoor air cooling heat exchanger (101) such that the dry-bulb temperature and the water vapor amount change to those at point L. Then, such air joins air passing through a passage (118) and indicated by point M, and therefore the water vapor amount of the joined air decreases (see point N). Such air is introduced into a dehumidification rotor (102) at a first stage, and then is dehumidified such that the dry-bulb temperature and the water vapor amount change to those at point O. Subsequently, such air joins air (see point Q) returning from an indoor space and flowing through a passage (114), and then the joined air is cooled by a cooling coil (105) (see point R). Then, a dehumidification rotor (106) at a second stage changes the air to low-dew-point air indicated by point S, and then such low-dew-point air is supplied to the inside of a room (dry clean room). The air indicated by point S contains little water vapor, and has a dew point of about −50° C.

The dehumidified air whose moisture adsorbs onto an adsorption part of the dehumidification rotor (106) flows into passages (115, 116), and then branches into a passage (117) and the passage (118). The air of the passage (117) is heated by a heater (107) so as to change to the state indicated by point T. Then, such air joins air flowing through the passage (115), and changes to the state indicated by point U. The air is, by a heater (108), further heated to a high-temperature (140° C.) indicated by point V, and desorbs moisture from the dehumidification rotor (102). Then, such air is discharged to the outside of the room. In this state, thermal energy of an electric heater or a steam heater is used as energy used for increasing the air temperature to the recovery temperature (140° C.). The air passing through the passage (118) and indicated by point W joins, after passing through the outdoor air cooling heat exchanger (101), air indicated by point L.

As described above, in the configuration of the comparative example, it is necessary that the recovery temperature of the dehumidification rotor (102) reaches a high temperature (140° C.), and therefore great energy is required regardless of using steam or electricity.

In the configuration of the comparative example, while the humidity of air having passed through the dehumidification rotor (102) at the first stage decreases, the temperature of such air increases. Thus, in order to obtain low-dew-point air, it is necessary that air is cooled at an inlet of the dehumidification rotor (106) at the second stage. For such a reason, great energy is consumed in the cooling coil (105).

In the conventional configuration described as the comparative example, an energy usage of an air conditioning system occupies about 50% of the total energy in a manufacturing process for lithium ion batteries. Such an energy usage is a great obstructive factor for energy conservation in a dry clean room and power saving.

In the system of the comparative example, the pressure of the return air passage (114) is a negative pressure, and therefore moisture contained in outdoor air enters the system. Although high airtightness is required for a duct (i.e., an air tunnel), it is highly likely that the humidity of air increases due to lowering of the airtightness, resulting in an unstable performance.

Embodiment

In the present embodiment illustrated in FIG. 6, since the adsorption heat exchangers (22, 24) of the refrigerant circuit are provided at the second stage, air can be simultaneously dehumidified and cooled. Thus, a cooling coil is not necessarily provided at a prior stage of the third-stage dry rotor (31).

Specifically, the temperature and humidity of air indicated by point A decrease after the air passes through the outdoor air cooling heat exchanger (61), and such air changes to the state indicated by point B. The temperature and humidity of the air indicated by point B further decrease after the air passes through the adsorption heat exchanger (22, 24), and such air changes to the state indicated by point C. The humidity of such air decreases (see point D) after the air joins air flowing through the return air passage (58) and indicated by point E. After passing through the adsorption rotor (31), the air changes to low-dew-point air (about −50° C.) substantially containing no water vapor and indicated by point F, and then the low-dew-point air is supplied to the inside of the room.

Adsorption dehumidification is performed using the adsorption heat exchangers (22, 24) as the second-stage dehumidification unit. Thus, referring to FIG. 5, low-dew-point air can be obtained, as well as decreasing the dry-bulb temperature. As a result, ideal dehumidification which is difficult to be realized by the dehumidification rotor (102) of FIG. 7 can be realized. That is, since the temperature and the humidity are decreased by the adsorption heat exchanger (22, 24), the amount of adsorption heat generated at the third-stage adsorption rotor (31) decreases due to low-temperature air, and therefore a temperature increase can be reduced. Moreover, although it is difficult to ensure a large adsorption area in the adsorption heat exchanger (22, 24) due to manufacturing problems, a larger adsorption area can be ensured in the adsorption rotor (31) than in the adsorption heat exchanger (22, 24). Thus, a dehumidification amount increases, and low-humidity low-temperature air can be obtained.

In the comparative example, a high temperature of about 140° C. is required as the recovery temperature for obtaining low-dew-point air (having a dew point of −50° C.). On the other hand, in the system of the present embodiment, air (see point G) heated by the recovery heat exchanger (65) and having a temperature of 60° C. can be used as the recovery air to obtain the similar type of low-dew-point air. Accordingly, energy required for recovery of the adsorption rotor (31) can be reduced. The air having passed through the adsorption rotor (31) and indicated by point H joins air flowing through the path (55), and such joined air changes to the state indicated by point I. Such air is used for recovery of the adsorption heat exchanger (22, 24).

The recovery temperature of the adsorption rotor (31) can be decreased using low-dew-point air (−15° C. to −20° C.) dehumidified by the adsorption heat exchanger (22, 24) provided at the second stage. In other words, low-dew-point air is supplied to the adsorption rotor (31). Thus, even if the air humidity decreases by adsorption of a large amount of moisture as described above, little adsorption heat is generated, and therefore the recovery temperature can be decreased.

The recovery temperature is 60° C. which is lower than that of the comparative example. Thus, it has been conventionally difficult to realize a heating technique using a heat pump as a heat source for recovery, whereas such a technique can be realized in the present embodiment.

In the present embodiment, the return air fan (59) provided in the return air passage (58) extending from the dry clean room allows the entirety of the system to be under a positive pressure. Thus, moisture contained in air is less likely to enter the system, resulting in enhancement of stability of the system.

<Other Control in Refrigerating Unit>

In the refrigerating unit (70) illustrated in FIG. 3, the following control is properly performed depending on operation conditions of the dehumidification system.

In the operation of the dehumidification system, the controller (110) calculates, based on temperatures detected by the temperature sensors (101-104), a required capacity Qc of a condenser (i.e., the recovery heat exchanger (65) and the reheat heat exchanger (64)) and a required capacity Qe of an evaporator (i.e., the outdoor air cooling heat exchanger (61) and the return air cooling heat exchanger (67)).

If the required capacity Qc of the condenser is higher than the required capacity Qe of the evaporator, the rotational speed of the compressor (80) is adjusted such that the condensation pressure detected by the high-pressure sensor (95) reaches a target condensation pressure determined based on the required capacity Qc. Accordingly, the condensation pressure can be promptly adjusted to the target condensation pressure, and therefore the required capacity Qc can be ensured.

When the compressor (80) is controlled such that the condensation pressure reaches the target value, there is a possibility that the evaporation pressure exceeds a target evaporation pressure and shortage of the required capacity Qe of the evaporation occurs accordingly. In such a case, the third expansion valve (84) is opened with a predetermined opening degree. When the third expansion valve (84) opens, refrigerant on the discharge side of the compressor (80) flows through both of the first discharge line (71) and the second discharge line (72), and is condensed in the condensation pressure adjustment heat exchanger (83). Then, the compressor (80) increases the rotational speed thereof such that the condensation pressure is maintained at the target condensation pressure. As a result, the evaporation pressure decreases so as to approach the target evaporation pressure.

If the required capacity Qe of the evaporator is higher than the required capacity Qc of the condenser, the rotational speed of the compressor (80) is adjusted such that the evaporation pressure detected by the low-pressure sensor (96) reaches the target evaporation pressure determined based on the required capacity Qe. Accordingly, the evaporation pressure can be promptly adjusted to the target evaporation pressure, and therefore the required capacity Qe can be ensured.

When the compressor (80) is controlled such that the evaporation pressure reaches the target value, there is a possibility that the condensation pressure falls below the target condensation pressure and shortage of the required capacity Qc of the condenser occurs accordingly. In such a case, the fourth expansion valve (87) is opened with a predetermined opening degree. When the fourth expansion valve (87) opens, refrigerant on the suction side of the compressor (80) flows through both of the first suction line (73) and the second suction line (74), and is evaporated in the evaporation pressure adjustment heat exchanger (88). Then, the compressor (80) increases the rotational speed thereof such that the evaporation pressure is maintained at the target evaporation pressure. As a result, the condensation pressure increases so as to approach the target condensation pressure.

In the refrigerating unit (70), the on-off valve (92) opens when the temperature of outdoor air (OA) detected by an outdoor air temperature sensor (not shown in the figure) is lower than the target evaporation pressure. This allows refrigerant to bypass the outdoor air cooling heat exchanger (61) and to be sent to the return air cooling heat exchanger (67).

Advantages of the Embodiment

According to the present embodiment, the recovery temperature can be, as described above, significantly decreased from 140° C. to 60° C. to reduce a recovery heat amount. Thus, great energy conservation can be realized. Calculation made under the foregoing conditions shows that a power consumption amount is reduced by about 35% and that a system running cost is significantly reduced. Moreover, since the recovery heat exchanger (65) is used as the heat exchanger of the refrigerant circuit (70*a*), energy conservation can be further enhanced.

In the present embodiment, the recovery temperature of the adsorption rotor (31) can be 60° C., exhaust heat generated from manufacturing facilities for lithium ion batteries can be used for recovery, and exhaust heat of the refrigerant circuit (70*a*) can be used for recovery. Thus, more energy conservation can be realized. Such use of exhaust heat is useful not only in the manufacturing facilities for lithium ion batteries but also in manufacturing lines of other factories.

The recovery heat exchanger (65), the outdoor air cooling heat exchanger (61), the reheat heat exchanger (64), and the return air cooling heat exchanger (67) are connected to the same refrigerant circuit (70*a*) in the refrigerating unit (70). Thus, heat of air collected by the outdoor air cooling heat exchanger (61) and the return air cooling heat exchanger (67) can be used for heating of air in the recovery heat exchanger (65) and the reheat heat exchanger (64). As a result, energy conservation in the dehumidification system can be improved.

Variations of the Embodiment of the Invention

Figure 8:
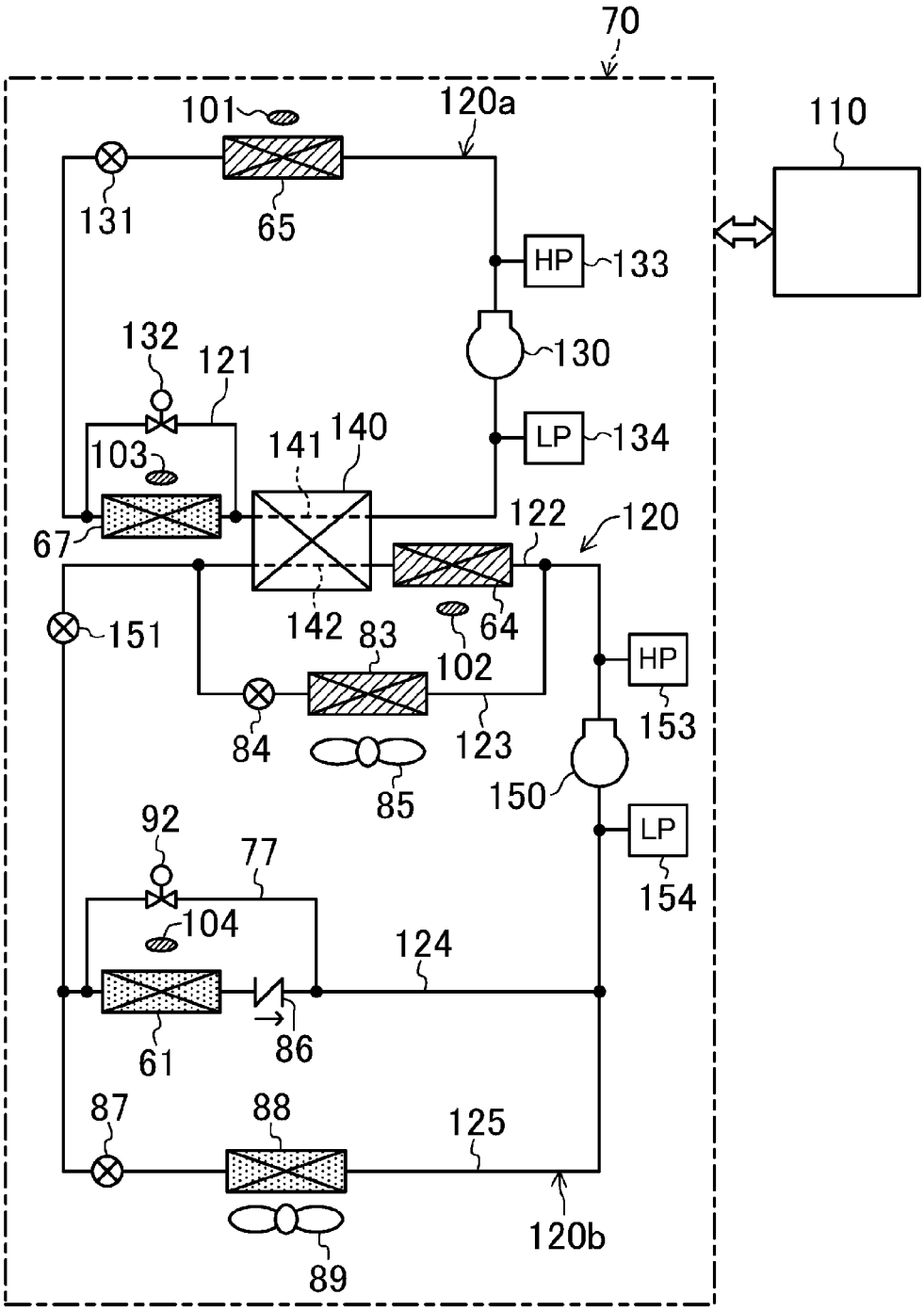
FIG. 8 is a piping diagram of a refrigerant circuit of a dehumidification system of a first variation of the embodiment.

A dehumidification system (10) of a first variation is different from that of the foregoing embodiment in the configuration of the refrigerating unit (70). Referring to FIG. 8, a two-stage cascade refrigeration cycle type refrigerant circuit (120) is provided in a refrigerating unit (70) of the first variation. That is, in the refrigerant circuit (120), a high-pressure circuit (120*a*) and a low-pressure circuit (120*b*) are connected together through a cascade heat exchanger (140) serving as an intermediate heat exchanger.

A high-pressure compressor (130) serving as a first compressor, a recovery heat exchanger (65), a high-pressure expansion valve (131), and a return air cooling heat exchanger (67) are connected together in this order in the high-pressure circuit (120*a*). A first flow path (141) of the cascade heat exchanger (140) is connected downstream of the return air cooling heat exchanger (67). A high-pressure bypass pipe (121) bypassing the return air cooling heat exchanger (67) is connected to the high-pressure circuit (120*a*). A high-pressure solenoid on-off valve (132) is provided in the high-pressure bypass pipe (121). In the high-pressure circuit (120*a*), a high-pressure sensor (133) is provided on a discharge side of the high-pressure compressor (130), and a low-pressure sensor (134) is provided on a suction side of the high-pressure compressor (130).

A low-pressure compressor (150) serving as a second compressor is provided in the low-pressure circuit (120*b*). The low-pressure compressor (150) branches, on a discharge side thereof, into a first discharge line (122) and a second discharge line (123). A reheat heat exchanger (64) and a second flow path (142) of the cascade heat exchanger (140) are connected to the first discharge line (122) in this order. A condensation pressure adjustment heat exchanger (83) and a third expansion valve (84) are connected to the second discharge line (123) in this order.

The low-pressure compressor (150) branches, on a suction side thereof, into a first suction line (124) and a second suction lines (125). An outdoor air cooling heat exchanger (61) and a check valve (86) are connected to the first suction line (124) in this order. As in the foregoing embodiment, a bypass pipe (77) is connected to the first suction line (124). A fourth expansion valve (87) and an evaporation pressure adjustment heat exchanger (88) are connected to the second suction lines (125) in this order.

In the low-pressure circuit (120*b*), a low-pressure expansion valve (151) is connected between an outlet end of each discharge line (122, 123) and an inlet end of each suction line (124, 125). In the low-pressure circuit (120*b*), a high-pressure sensor (153) is provided on the discharge side of the low-pressure compressor (150), and a low-pressure sensor (154) is provided on the suction side of the low-pressure compressor (150).

In the refrigerating unit (70) of the first variation, a two-stage cascade refrigeration cycle is performed. Refrigerant compressed in the high-pressure compressor (130) is condensed by dissipating heat to air in the recovery heat exchanger (65). Then, the pressure of the refrigerant is reduced in the high-pressure expansion valve (131). The depressurized refrigerant is evaporated by absorbing heat from air in the return air cooling heat exchanger (67). Then, the refrigerant flows through the first flow path (141) of the cascade heat exchanger (140). In the cascade heat exchanger (140), the refrigerant flowing through the first flow path (141) is evaporated by absorbing heat from refrigerant flowing through the second flow path (142). The evaporated refrigerant is sucked into the high-pressure compressor (130), and then is compressed.

Refrigerant compressed in the low-pressure compressor (150) is condensed by dissipating heat to air in the reheat heat exchanger (64). Then, the refrigerant flows through the second flow path (142) of the cascade heat exchanger (140). In the cascade heat exchanger (140), the refrigerant flowing through the second flow path (142) is condensed by dissipating heat to refrigerant flowing through the first flow path (141). The pressure of the condensed refrigerant is reduced by the low-pressure expansion valve (151), and then such refrigerant flows into the outdoor air cooling heat exchanger (61). In the outdoor air cooling heat exchanger (61), the refrigerant is evaporated by absorbing heat from air. The evaporated refrigerant is sucked into the low-pressure compressor (150), and then is compressed.

As just described, in the refrigerating unit (70) of the first variation, refrigerant circulates through each of the high-pressure circuit (120*a*) and the low-pressure circuit (120*b*) to perform the refrigeration cycle. A sufficient differential pressure between a condensation pressure of the recovery heat exchanger (65) and an evaporation pressure of the outdoor air cooling heat exchanger (61) can be ensured, and therefore a sufficient heating capacity of the recovery heat exchanger (65) and a sufficient cooling capacity of the outdoor air cooling heat exchanger (61) can be obtained.

Configurations, features, and advantages of the first variation other than the above are similar to those of the foregoing embodiment.

Figure 9:
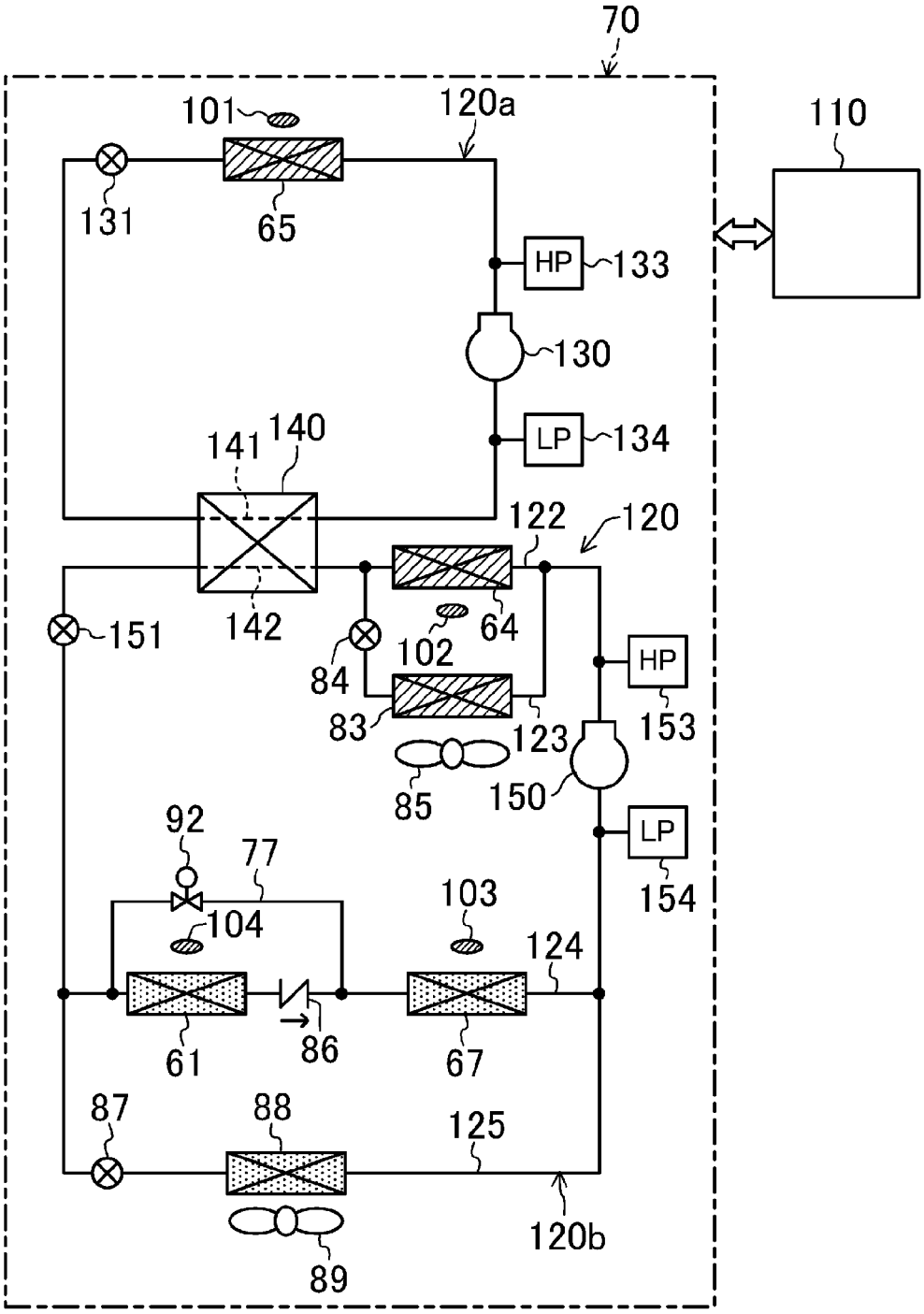
FIG. 9 is a piping diagram of a refrigerant circuit of a dehumidification system of a second variation of the embodiment.

FIG. 9 illustrates a second variation. Referring to FIG. 9, a return air cooling heat exchanger (67) may be connected to part of a first suction line (124) of a low-pressure circuit (120*b*) downstream of an outdoor air cooling heat exchanger (61).

Figure 10:
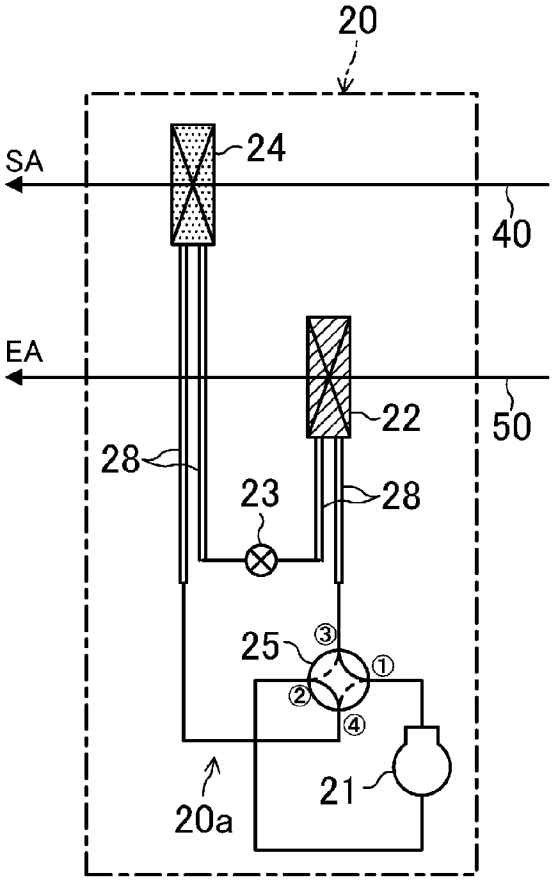
FIGS. 10(A) and 10(B) are diagrams illustrating a second dehumidification unit of a dehumidification system of a third variation of the embodiment.
Figure 10:
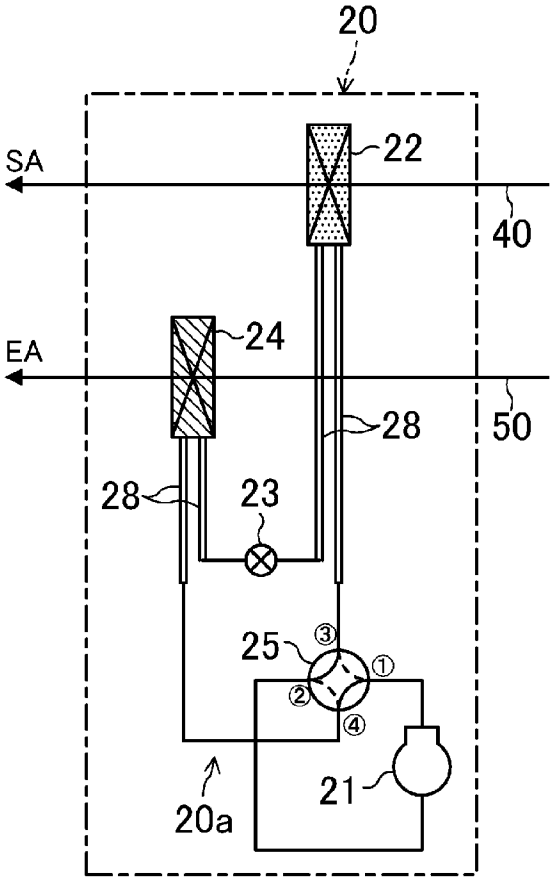

FIGS. 10(A) and 10(B) illustrate a third variation. In the second dehumidification unit (20) of the foregoing embodiment, the air passage switching mechanism (26, 27) configured to change the flows of air into the adsorption heat exchangers (22, 24) is provided. Moreover, the refrigerant flow path switching mechanism (25) is provided in the dehumidification refrigerant circuit (20*a*). Such mechanisms switch the air flow and the refrigerant flow to connect the adsorption heat exchanger serving as the evaporator to the air supply passage (40) and to connect the adsorption heat exchanger serving as the condenser to the air discharge passage (50). However, referring to FIGS. 10(A) and 10(B), the air passage switching mechanism (dampers) (26, 27) may not be used.

As in the foregoing embodiment, a dehumidification refrigerant circuit (20*a*) of a second dehumidification unit (20) of the present variation is configured such that a compressor (21), a first adsorption heat exchanger (22), an expansion valve (23), a second adsorption heat exchanger (24), and a four-way valve (25) are connected together. In the dehumidification refrigerant circuit (20*a*), pipes (28) each indicated by a double line in FIGS. 10(A) and 10(B) are extendable and bendable flexible pipes. Although not shown in the figure, a mechanism configured to change the positions of the first adsorption heat exchanger (22) and the second adsorption heat exchanger (24) is provided.

According to such a configuration, in the state illustrated in FIG. 10(A), the first adsorption heat exchanger (22) serving as an evaporator is positioned on an air discharge passage (50), and the second adsorption heat exchanger (24) serving as a condenser is positioned on an air supply passage (40). In the state illustrated in FIG. 10(B), the first adsorption heat exchanger (22) serving as the evaporator is positioned on the air supply passage (40), and the second adsorption heat exchanger (24) serving as the condenser is positioned on the air discharge passage (50).

In the example of FIGS. 10(A) and 10(B), since the positions of the first adsorption heat exchanger (22) and the second adsorption heat exchanger (24) are changed, air supplied to the inside of a room is constantly dehumidified without switching the air supply passage (40) and the air discharge passage (50). Moreover, since a first dehumidification unit (60) and a third dehumidification unit (30) are configured as in the foregoing embodiment, advantages similar to those of the foregoing embodiment can be realized.

Other Embodiments

The foregoing embodiment may have the following configurations.

In the foregoing embodiment, the recovery heat exchanger (65) of the refrigerant circuit is used as the air heater. However, e.g., an electric heater or a steam heater may be used as the air heater.

In the foregoing embodiment, an intermediate cooler may be provided between the second dehumidification unit (20) and the third dehumidification unit (30) to cool air.

In the foregoing embodiment, the return air passage (58) through which indoor air (RA) is sent back to the air supply passage (40) is formed. However, the return air passage (58) is not necessarily formed.

In the foregoing embodiment, part of indoor air sent back to the air supply passage (40) through the return air passage (58) is used as air for recovery of the adsorption rotor (31). However, such a configuration is not necessarily employed, and the configuration for circulating air may be changed such that part of outdoor air is dehumidified and supplied to the indoor space (S) and the remaining part of the outdoor air is used for recovery of the adsorption rotor (31).

The dehumidification system of the present disclosure may be an optionally-attachable system configured such that the second dehumidification unit (20) is connected between the first dehumidification unit (60) and the third dehumidification unit (30) provided in an existing system. Thus, the second dehumidification unit (20) including the adsorption heat exchangers (22, 24) can be attached to the conventionally-used double-stage system including only the outdoor air cooling heat exchanger (61) and the adsorption rotor (31), resulting in energy conservation in the existing system.

The foregoing embodiments have been set forth merely for the purpose of preferred examples in nature, and are not intended to limit the scope, applications, and use of the invention.

INDUSTRIAL APPLICABILITY

As described above, the present disclosure is useful for the dehumidification system configured to supply dehumidified air to the inside of the room.

DESCRIPTION OF REFERENCE CHARACTERS

10 Dehumidification System
20 Second Dehumidification Unit
22 First Adsorption Heat Exchanger
24 Second Adsorption Heat Exchanger
25 Refrigerant flow Path Switching Mechanism (Four-Way Valve)
26 First Flow Path Switcher (Air Passage Switching Mechanism)
27 Second Flow Path Switcher (Air Passage Switching Mechanism)
30 Third Dehumidification Unit
31 Adsorption Rotor
40 Air Supply Passage (Air Passage)
50 Air Discharge Passage (Air Passage)
58 Return Air Passage
**58*a*** Return Air Port
59 Return Air Fan
60 First Dehumidification Unit
61 Outdoor Air Cooling Heat Exchanger
65 Recovery Heat Exchanger (Air Heater)
67 Return Air Cooling Heat Exchanger (Return Air Cooler)
**70*a*** Refrigerant Circuit
120 Refrigerant Circuit
S Indoor Space

The invention claimed is:

1. A dehumidification system comprising:
an air passage having
an air supply passage through which air supplied to an indoor space (S) passes, and
an air discharge passage through which air discharged to an outside of a room passes; and
a dehumidification unit disposed in the air passage,
wherein the dehumidification unit includes a first dehumidification unit, a second dehumidification unit, and a third dehumidification unit which are arranged in this order from a side close to an inlet of air supplied to an inside of the room toward the indoor space (S),
the first dehumidification unit includes an outdoor air cooling heat exchanger configured to cool and dehumidify air supplied to the inside of the room,
the second dehumidification unit includes two adsorption heat exchangers configured to be switchable such that an adsorption side and a recovery side interchange with each other, and is configured such that air dehumidified in the first dehumidification unit is further dehumidified in one of the adsorption heat exchangers on the adsorption side, and
the third dehumidification unit includes an adsorption rotor, part of which serves as an adsorption part and another part of which serves as a recovery part, and is configured such that air dehumidified in the second dehumidification unit is further dehumidified in the adsorption part.

2. The dehumidification system of claim 1, wherein
the third dehumidification unit further includes, in addition to the adsorption rotor, an air heater disposed on a side close to an inlet of air for recovery of the adsorption rotor.

3. The dehumidification system of claim 2, wherein
the air heater is a recovery heat exchanger which is provided in a refrigerant circuit configured to perform a refrigeration cycle and which serves as a condenser.

4. The dehumidification system of claim 3, wherein
the refrigerant circuit is a refrigerant circuit in which the recovery heat exchanger serves as the condenser and the outdoor air cooling heat exchanger serves as an evaporator.

5. The dehumidification system of claim 4, wherein
a reheat heat exchanger which is disposed downstream of the adsorption rotor in the air supply passage and which serves as the condenser, and a return air cooling heat exchanger which is disposed in a return air passage connecting a return air port communicating with the indoor space (S) to part of the air supply passage between the second dehumidification unit and the third dehumidification unit and which is provided as an air cooler serving as the evaporator are connected to the refrigerant circuit.

6. The dehumidification system of claim 5, wherein
the refrigerant circuit is a single-stage refrigeration cycle type refrigerant circuit in which the condenser and the evaporator are connected to a single closed circuit.

7. The dehumidification system of claim 6, wherein
a variable displacement compressor configured to control, when a required capacity of the condenser is higher than a required capacity of the evaporator, a rotational speed thereof such that a condensation pressure approaches a target pressure and to control, when the required capacity of the evaporator is higher than the required capacity of the condenser, the rotational speed thereof such that an evaporation pressure approaches a target pressure is connected to the refrigerant circuit.

8. The dehumidification system of claim 5, wherein
the refrigerant circuit is a two-stage cascade refrigeration cycle type refrigerant circuit including
a high-pressure circuit in which a first compressor and the recovery heat exchanger are connected together to perform a refrigeration cycle,
a low-pressure circuit in which a second compressor and the outdoor air cooling heat exchanger are connected together to perform a refrigeration cycle, and
an intermediate heat exchanger configured to exchange heat between low-pressure refrigerant of the high-pressure circuit and high-pressure refrigerant of the low-pressure circuit.

9. The dehumidification system of claim 2, wherein
the air heater is an electric heater or a steam heater.

10. The dehumidification system of claim 1, wherein
the second dehumidification unit and the third dehumidification unit are configured such that
the adsorption part of the adsorption rotor is positioned downstream of the air supply passage relative to one of the adsorption heat exchangers on the adsorption side, and
the other one of the adsorption heat exchangers on the recovery side is positioned downstream of the air discharge passage passing through the recovery part of the adsorption rotor.

11. The dehumidification system of claim 10, wherein the adsorption heat exchangers of the second dehumidification unit are two heat exchangers provided in a refrigerant circuit, the second dehumidification unit includes a refrigerant flow path switching mechanism configured to reverse a refrigerant flow direction in the refrigerant circuit to alternately switch each adsorption heat exchanger to serve as an evaporator on the adsorption side or a condenser on the recovery side, and an air passage switching mechanism configured to switch an air flow to connect one of the adsorption heat exchangers serving as the evaporator to the air supply passage and to connect the other one of the adsorption heat exchangers serving as the condenser to the air discharge passage, the adsorption rotor of the third dehumidification unit is disposed so as to extend over both of the air supply passage and the air discharge passage, and is rotatable about a rotary shaft interposed between the air supply passage and the air discharge passage, and part of the adsorption rotor through which the air supply passage passes serves as the adsorption part, and another part of the adsorption rotor through which the air discharge passage passes serves as the recovery part.

12. The dehumidification system of claim 1, wherein the second dehumidification unit and the third dehumidification unit are directly connected together through the air supply passage without an intermediate cooler being interposed therebetween.

13. The dehumidification system of claim 1, further comprising:

a return air passage connecting a return air port communicating with the indoor space (S) to part of the air supply passage between the second dehumidification unit and the third dehumidification unit.

14. The dehumidification system of claim 13, wherein a return air fan configured to push indoor air toward the air supply passage is provided in the return air passage.

15. The dehumidification system of claim 13, wherein a return air cooler configured to cool air flowing through the return air passage is provided in the return air passage.

16. The dehumidification system of claim 1, wherein an adsorbent provided on the adsorption heat exchangers is an adsorbent showing an adsorption isotherm indicating that a higher relative humidity of air results in a greater adsorption amount per unit increment of the relative humidity, and an adsorbent provided on the adsorption rotor is an adsorbent showing an adsorption isotherm indicating that a lower relative humidity of air results in a greater adsorption amount per unit increment of the relative humidity.

17. The dehumidification system of claim 1, wherein in an existing system including the first dehumidification unit and the third dehumidification unit, the second dehumidification unit is connected between the first dehumidification unit and the third dehumidification unit.

* * * * *